US007784561B2

(12) United States Patent
Lim

(10) Patent No.: US 7,784,561 B2
(45) Date of Patent: Aug. 31, 2010

(54) GROUND DRILLING HAMMER AND THE DRIVING METHOD

(76) Inventor: Byung-Duk Lim, 106-1803, The Sharp Apt., Hyoja-dong 2ga, Wansan-gu, Jeonju-si, Jeollabuk-do (KR) 560-859

( * ) Notice: Subject to any disclaimer, the term of this patent is extended or adjusted under 35 U.S.C. 154(b) by 263 days.

(21) Appl. No.: 11/720,219

(22) PCT Filed: Dec. 1, 2005

(86) PCT No.: PCT/KR2005/004075

§ 371 (c)(1),
(2), (4) Date: May 25, 2007

(87) PCT Pub. No.: WO2006/062309

PCT Pub. Date: Jun. 15, 2006

(65) Prior Publication Data

US 2007/0251710 A1 Nov. 1, 2007

(30) Foreign Application Priority Data

Dec. 7, 2004 (KR) ..... 10-2004-0102256
Apr. 8, 2005 (KR) ..... 10-2005-0029503
Nov. 22, 2005 (KR) ..... 10-2005-0111836

(51) Int. Cl.
*B23B 41/02* (2006.01)

(52) U.S. Cl. ..... 173/14; 173/1; 173/13

(58) Field of Classification Search ..... 173/13–17, 173/59, 73, 78–79, 80, 91
See application file for complete search history.

(56) References Cited

U.S. PATENT DOCUMENTS 1,518,124 A * 12/1924 Mercer ..... 173/64
1,899,438 A * 2/1933 Grant ..... 175/95
2,087,583 A * 7/1937 Smith, Sr. ..... 173/65
2,756,723 A * 7/1956 Bassinger ..... 173/73
2,937,619 A * 5/1960 Kurt ..... 173/17
2,979,033 A * 4/1961 Bassinger ..... 173/73
3,085,555 A * 4/1963 Morrison ..... 173/197
3,136,375 A * 6/1964 Lear et al. ..... 173/16

(Continued)

*Primary Examiner*—Rinaldi I. Rada
*Assistant Examiner*—Lindsay Low

(57) ABSTRACT

Disclosed herein is a pneumatic operated hammer for rock drilling, the hammer comprising a cylindrical casing, a back head mounted at an upper portion of the casing, a check valve for opening/closing a compressed air passageway in the casing, a guide for supporting the check valve, a piston adapted to ascend and descend with compressed air in the casing, and a button bit for performing a drilling work through the striking of the piston. The piston is extended to a certain length to conform to the work condition of the pneumatic hammer to thereby prevent a water back-flow phenomenon in which underground water, etc., is introduced into the drilling equipment during the drilling work, compressed air passageways and variable compressed air chambers are formed between the piston and the casing so that when the piston ascends by the compressed air, it abruptly ascends at a load-free state, and the piston has axial portions with a reference diameter and different outer diameters so that it is possible to manufacture a hammer bit having a plurality of variable compressed air chambers formed between the casing the piston to fit for the work capacity. The piston ascended in a load-free state strikes the button bit with its rapid and strong striking force produced by the compressed air supplied from the variable chambers while abruptly descending to thereby perform the drilling work.

7 Claims, 18 Drawing Sheets

U.S. PATENT DOCUMENTS 3,431,984 A * 3/1969 Buehler et al. ..... 173/78
3,480,088 A * 11/1969 Ghelfi ..... 173/78
3,826,316 A * 7/1974 Bassinger ..... 173/73
3,924,690 A * 12/1975 Shaw ..... 173/13
3,946,819 A * 3/1976 Hipp ..... 175/296
3,964,551 A * 6/1976 Bassinger ..... 173/73
3,970,152 A * 7/1976 Harris et al. ..... 173/15
3,970,153 A * 7/1976 Gien et al. ..... 173/17
4,015,670 A * 4/1977 Rear ..... 173/15
4,054,180 A * 10/1977 Bassinger ..... 173/136
4,084,646 A * 4/1978 Kurt ..... 173/17
4,084,647 A * 4/1978 Lister ..... 173/73
4,194,581 A * 3/1980 Walter ..... 175/92
4,402,370 A * 9/1983 Gein et al. ..... 173/73
4,530,408 A * 7/1985 Toutant ..... 173/17
4,591,004 A * 5/1986 Gien ..... 173/17
4,790,390 A * 12/1988 Sweeny ..... 173/17
4,819,739 A * 4/1989 Fuller ..... 173/17
4,821,812 A * 4/1989 Ditzig ..... 173/17
4,924,948 A * 5/1990 Chuang et al. ..... 173/211
5,025,868 A * 6/1991 Wentworth et al. ..... 173/91
5,080,179 A * 1/1992 Gien et al. ..... 173/17
5,085,284 A * 2/1992 Fu ..... 175/296
5,094,303 A * 3/1992 Jenne ..... 173/91
5,109,932 A * 5/1992 Bueter et al. ..... 173/17
5,115,717 A * 5/1992 Roemer ..... 91/49
5,131,476 A * 7/1992 Harrington ..... 173/17
5,205,363 A * 4/1993 Pascale ..... 173/17
5,322,136 A * 6/1994 Bui et al. ..... 175/65
5,350,023 A * 9/1994 Klemm ..... 173/17
5,377,551 A * 1/1995 Vacquer ..... 73/864.45
5,419,403 A * 5/1995 Klemm ..... 173/115
5,465,797 A * 11/1995 Wentworth et al. ..... 173/91
5,505,270 A * 4/1996 Wentworth ..... 173/1
5,558,167 A * 9/1996 Hesse ..... 173/91
5,564,510 A * 10/1996 Walter ..... 175/296
5,566,771 A * 10/1996 Wolfer et al. ..... 175/296
RE36,166 E * 3/1999 Johns et al. ..... 175/61
5,944,117 A * 8/1999 Burkholder et al. ..... 173/91
5,984,021 A * 11/1999 Pascale ..... 173/90
5,992,537 A * 11/1999 Pascale ..... 173/91
6,050,347 A * 4/2000 Jenne ..... 173/91
6,062,322 A * 5/2000 Beccu et al. ..... 173/91
6,131,672 A * 10/2000 Beccu et al. ..... 173/91
6,209,666 B1 * 4/2001 Beccu et al. ..... 175/296
6,454,026 B1 * 9/2002 Shofner ..... 175/296
6,499,544 B1 * 12/2002 Shofner ..... 173/91
6,883,618 B1 * 4/2005 Pascale ..... 173/91
6,923,270 B1 * 8/2005 Randa ..... 173/91
6,953,095 B2 * 10/2005 Randa ..... 173/1
7,469,751 B2 * 12/2008 Gien ..... 173/15
2002/0011360 A1 * 1/2002 Gien ..... 175/296

* cited by examiner

GROUND DRILLING HAMMER AND THE DRIVING METHOD

TECHNICAL FIELD

The present invention relates to a pneumatic operated hammer for use in earth and rock drilling and boring operations and driving method thereof, and more particularly, to such a drilling pneumatic hammer in which air passageways are arranged at regular intervals circumferentially on a circle having a common center with an inner hollow space of the back head to supply the compressed air required for driving the hammer in a central and distributed manner, in which the piston is extended to a certain length to conform to the work condition of the pneumatic hammer to thereby prevent a water back-flow phenomenon in which underground water, etc., is introduced into the drilling equipment during the drilling work, in which the outer diameters of respective axial portions of the piston are formed differently from one another to form variable compressed air chambers between the piston and the casing so that when the piston ascends by the compressed air, it abruptly ascends at a load-free state, and in which the piston strikes the button bit with its strong striking force to perform the drilling work while the piston abruptly descends due to the compressed air applied integrally in a plurality of variable air chambers, thereby improving the drilling work efficiency and saving the time and cost required for the maintenance and repair of the drilling equipment, and a driving method thereof.

BACKGROUND ART

As examples of a pneumatic operated hammer for earth and rock drills, a down-on-the hole hammer is disclosed in European patent EP B1 0 336 010 or U.S. Pat. No. 4,015,670. However, the above patent has demerits in that a known piston of the down-on-the hole hammer is geometrically very complex, its repair and maintenance is very difficult and a mechanical trouble occurs frequently to thereby degrade a working efficiency. Further, when the lower end of the piston strikes an anvil portion of a drill bit, a compressed air supply is interrupted to thereby hinder the operation of the hammer.

As an improvement over such a conventional invention, there is disclosed Korean Patent Laid-Open Publication No. 2001-52919 published on Jun. 25, 2001 and entitled "percussive down-the-hole-rock drilling hammer". However, this patent also embraces shortcomings in that the supply of pressurized air is performed only through an aperture of a central passageway of a piston and outlet apertures of a feed tube, so that the function of the compressed air for the ascending and descending, i.e., the upward and downward movements of a piston is not carried out efficiently, and since the arithmetic ratio of resistance and density of the component parts is applied to the drilling hammer, the drilling hammer does not have a function capable of preventing back flow of underground water or sludge at the time of the actual drilling work.

Furthermore, since a check valve for selectively blocking pressurized air is readily worn or exceeds fatigue strength due to a frequent striking to thereby suffer a partial crack or damage, leading to the frequent stopping of the drilling work. As a result, the work efficiency is deteriorated and the drilling equipment is not easy to repair and maintain.

DISCLOSURE OF INVENTION

Technical Problem

Accordingly, the present invention has been made to solve the above-described problems, and it is an object of the present invention to provide a pneumatic operated hammer for use in earth and rock drilling and boring operations and driving method thereof, in which the upward and downward movement of a piston using compressed air is efficiently carried out a new design of the supply scheme of compressed air, in which the piston is fabricated to have a predetermined length fitting for a desired drilling work so that it is possible to prevent a degradation in a function or a damage of the hammer due to water back-flowing into the drilling hammer, in which the flow structure of compressed air is efficiently improved through an additional formation of variable compressed-air chambers so that the ascending and descending of the piston is performed smoothly to thereby enhance the drilling work efficiency, and in which the environment of the drilling work is greatly improved in terms of time and economic aspect.

Technical Solution

The above object is accomplished by the construction and operation principle of the present invention, in which the feed structure of compressed air is innovatively designed in a central feed scheme to improve the flow of compressed air so that compressed air in the center hole of a back head is distributed through compressed air passageways arranged circumferentially on a circle having the common center with the inner hollow space of the back head and the compressed air is fed to a plurality of compressed-air chamber to effect the upward and downward reciprocation of the piston, the compressed-air chambers being formed by a space defined between the piston and a casing, and in which the length of the piston calculated on a structural and mechanical basis is set to prevent the back flow of water into the drilling equipment.

According to the present invention to which this operation principle is applied, the compressed-air chambers are formed between the piston and the casing to enable the piston to be reciprocatingly moved upwardly and downwardly within the casing to which compressed air is fed, and the rapid upward and downward movement of the piston is effected by the compressed air fed through air passageways communicating with the compressed-air chambers to thereby further enhance its striking force.

BRIEF DESCRIPTION OF THE DRAWINGS

Further objects and advantages of the invention can be more fully understood from the following detailed description taken in conjunction with the accompanying drawings, in which.

BEST MODE FOR CARRYING OUT THE INVENTION

Now, an explanation of the preferred embodiment of the present invention will be in detail given with reference to attached drawings.

Figure 1:
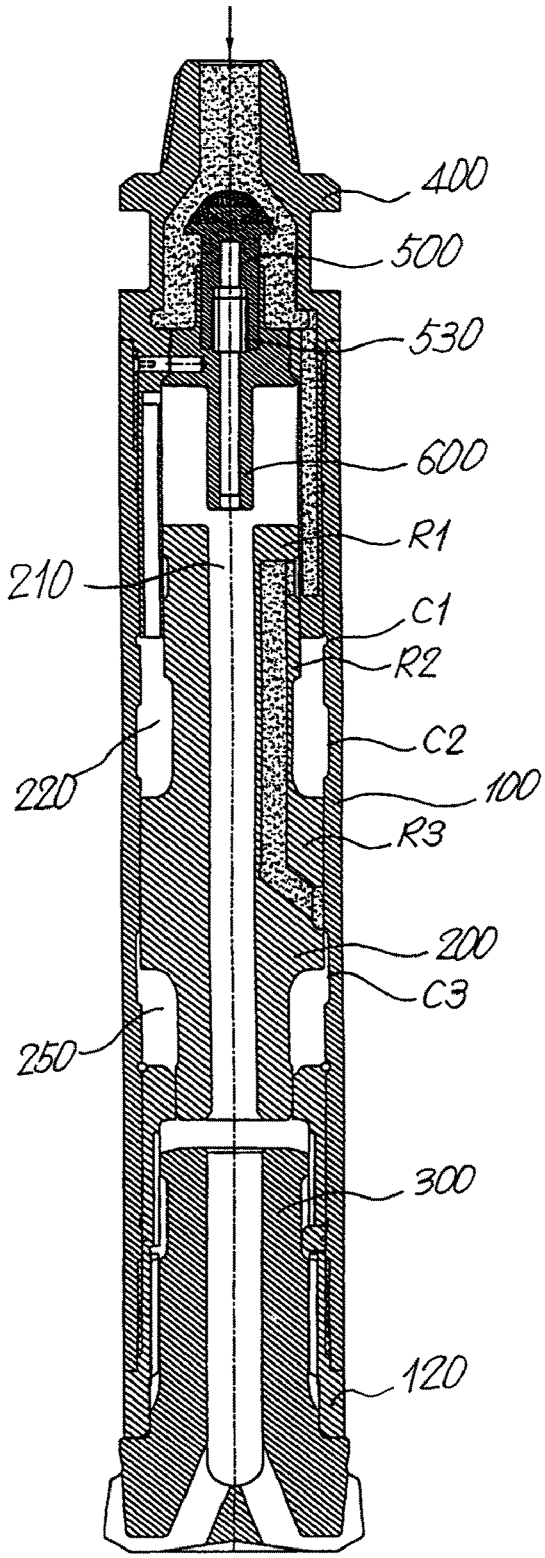
FIG. 1 is a cross-sectional view of a pneumatic operated hammer for rock drilling in an assembly state according to a first embodiment of the present invention.

As shown in FIG. 1, a first embodiment of the present invention is implemented with a concrete shape and structure of the following components. That is, in case of a pneumatic operated hammer for rock drilling in which a piston 200 strikes a button bit 300 while vertically reciprocating in a cylindrical casing 100 so that the drilling work is carried out, a back head 400 is screw-engaged with the upper portion of the casing 100 with the back head having a center hole 410 for inflow of compressed air and an inner hollow space 420 for receiving a check valve 500 therein and two kinds of air passageways arranged around the inner hollow space 420. A guide 600 is engaged with the lower end of the check valve 500 by means of a coil spring 530 and is construed such that its shaft portion 610 advances to and retracts from a center hole 210 of the piston 200. A chuck 120 formed integrally with a bushing portion 110 is disposed at an inner periphery of the lower end portion of the casing 100 so that the piston 200 and the button bit 300 are prevented from being shaken due to an axial play of the piston and button bit when they ascend and descend in the casing and a compressed air sealing function is effected.

Under the above structure, a driving method of the pneumatic operated hammer for rock drilling comprises: a first step of waiting for a drilling work in a load-free state even when the pneumatic operated hammer is supplied with compressed air at a drilling position; a second step of expanding variable compressed-air chambers through compressed air passageways to abruptly ascend the piston 200 in the casing; and a third step of supplying compressed air to the piston 200 positioned at a vertex point through the compressed air passageways to expand other variable compressed-air chambers between the piston 200 and the casing 100 to thereby abruptly descend the piston 200.

The chuck 120 formed with a bushing portion 110 is screw-engaged with an inner periphery of the lower end portion of the casing 100 so that the piston 200 vertically reciprocates within a range corresponding to a length limited by the chuck 120 in the casing 100. Further, the back head 400 is formed of a warhead-shaped structure that has a center hole 410 for supply of compressed air and an inner hollow space 420. The guide 600 is fastened to the inner hollow space 420 of the back head 400 in such a fashion as to be engaged integrally or separately with the back head. The check valve 500 elastically supported by a coil spring 530 is installed at the central upper portion of the guide 600 so as to open and close the center hole 410 and the inner hollow space 420 of the back head 400.

Figure 2:
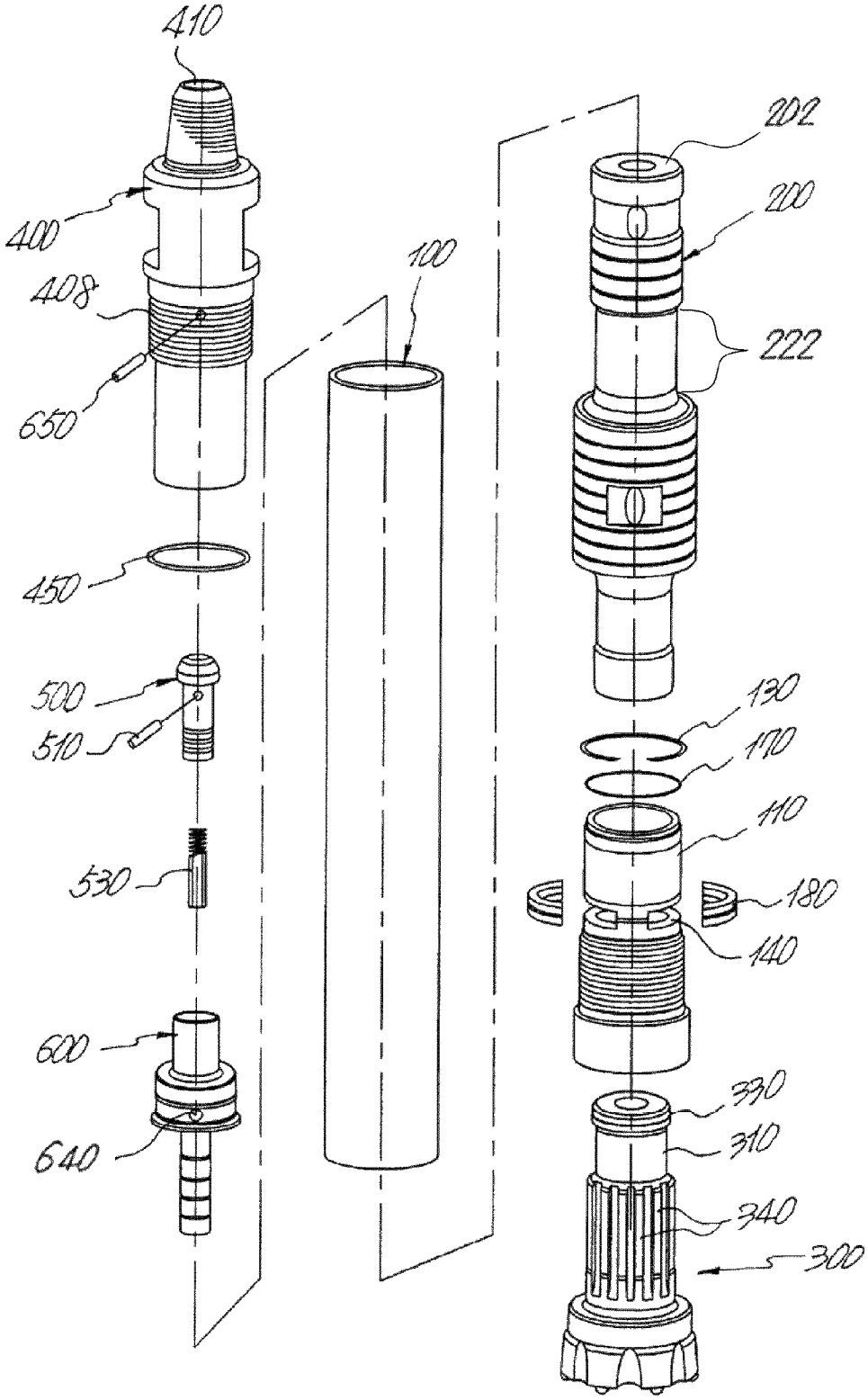
FIG. 2 is an exploded perspective view of FIG. 2.

FIG. 2 is an exploded perspective view of a pneumatic operated hammer for rock drilling in an assembly state according to a first embodiment of the present invention.

Referring to FIG. 2, there are shown the back head 400 adapted to be mounted at the inner periphery of the upper end portion of the casing 100, an O-ring 450, the check valve 500, a plug 510, the coil spring 530 adapted to be mounted at inner hole 520 of the check valve 500, and the guide 600 formed at the outer peripheral surface thereof with a stopper hole 640, which are disassembled in this order. In this case, the piston 200 and the chuck 120 mounted to the lower end of the casing 100, and the button bit 300 performing the drilling work owing to the collision with the piston 200 are shown. Reference numerals which are not explained in FIG. 2, a reference numeral 110 denotes bushing, 130 denotes a stop ring, a reference numeral 140 denotes a bit retainer recess, a reference numeral 170 denotes an O-ring, a reference numeral 180 denotes a bit retainer ring, a reference numeral 340 denotes guide grooves, and a reference numeral 650 denotes a stopper for allowing the guide 600 to be engaged with the back head 400.

Figure 3:
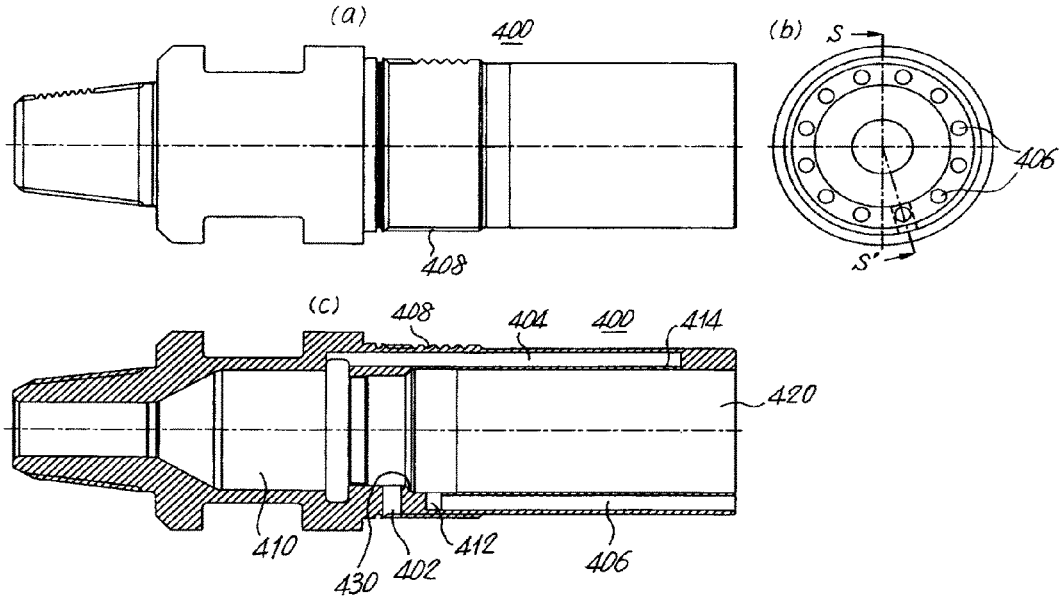
FIG. 3 is a view illustrating the construction of a back head 400 in FIG. 1, wherein FIG. 3(*a*) is a front view of the back head, FIG. 3(*b*) is a right side view of FIG. 3(*a*), and FIG. 3(*c*) is a cross-sectional view taken along the line S-S' of FIG. 3(*b*)

FIG. 3 is a view illustrating the construction of a back head 400 in FIG. 1, wherein FIG. 3(*a*) is a front view of the back head, FIG. 3(*b*) is a right side view of FIG. 3(*a*), and FIG. 3(*c*) is a cross-sectional view taken along the line S-S' of FIG. 3(*b*).

In FIG. 3, the upper end portion of the back head 400 is formed in a hollow cylindrical and frusto-conical shape such that it can engage with an existing rotatable drill pipe string (not shown) that is supplied with compressed air. As shown in FIG. 3(*c*), air passageways 404 fluidly communicating with the center hole 410 and the inner hollow space 420 of the back head 400 is closed at its bottom end (the right side of the drawing), and other air passageways 406 are opened at their lower ends so that it can fluidly communicate with the inner hollow space 420 and compressed-air chambers 220 formed between the casing 100 and the piston 200 which will be described later. The first air passageways 404 is connected with the inner hollow space 420 via a outlet aperture 414 at the lower portion and the second air passageways 406 is connected with the inner hollow space 420 via a inlet aperture 412 at the upper portion. The center hole 410 and the inner hollow space 420 are divided by inner peripheral edge portion 430 each other.

The air passageways 406 are arranged at regular intervals circumferentially on the circle having the common center with the inner hollow space 420 of the back head 400 (see FIG. 3(*b*)). In this case, the air passageways 406 opened at their lower ends and the air passageways 404 fludically communicating with the inner hollow space 420 via an outlet aperture 414 are alternately arranged circumferentially. Also, the front end portion of the back head 400 is formed in a truncated-conical shape, and screw threads 408 are formed on the outer peripheral surface of an intermediate portion of the back head 400 so that they can engage with screw threads which will be described later formed on the inner peripheral surface of a front end portion of the casing 100 by screw-engagement. A reference numeral 402 which is not explained in the drawing indicates a pin hole.

Figure 4:
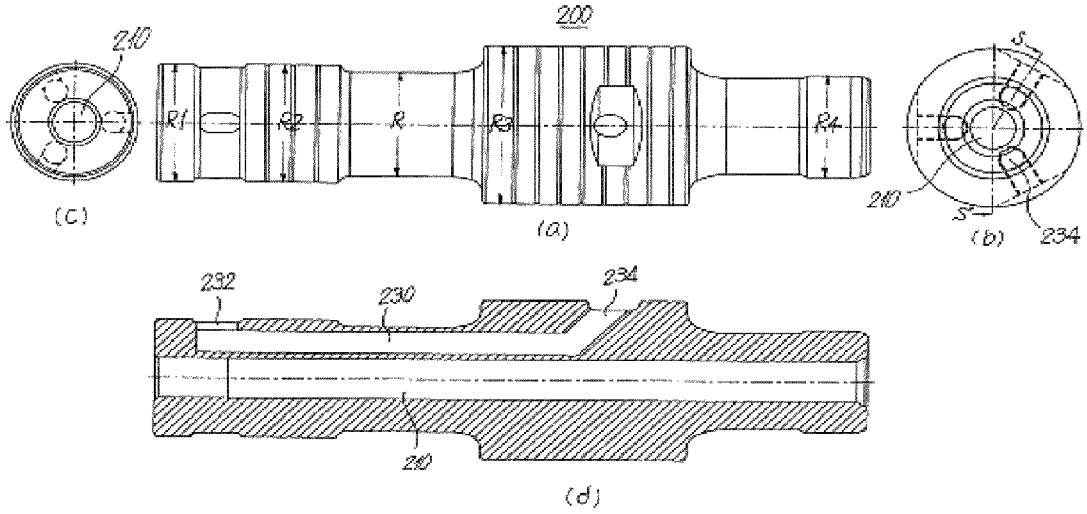
FIG. 4 is a view illustrating the construction of a piston 200 of FIG. 1, wherein FIG. 4(*a*) is a front view of the piston, FIG. 4(*b*) is a right side view of FIG. 4(*a*), FIG. 4(*c*) is a left side view of FIG. 4(*a*), and FIG. 4(*d*) is a cross-sectional view taken along the line S-S' of FIG. 4(*b*)

FIG. 4 is a view illustrating the construction of a piston 200 of FIG. 1, wherein FIG. 4(*a*) is a front view of the piston, FIG. 4(*b*) is a right side view of FIG. 4(*a*), FIG. 4(*c*) is a left side view of FIG. 4(*a*), and FIG. 4(*d*) is a cross-sectional view taken along the line S-S' of FIG. 4(*b*) to show the inner structure of the piston 200. The piston as shown in FIG. 4(*a*) has an central shaft with a certain outer diameter R and a center hole 210 perforated therein. In this case, axial portions having outer diameters R1, R2, R3 and R4 greater than the outer diameter R of the central shaft are formed in such a fashion as to be different in length from one another. Therefore, as shown in FIG. 1, the piston 200 is designed such that effective sealing function is provided while minimizing the friction resistance at the contact surface between the axial portions having extended outer diameters R1, R2, R3 and R4 and the inner wall of the casing 100 having extended inner diameters C1, C2 and C3, as well as the contact surface between the axial portions having different outer diameters R1, R2 R3 and R4 and the inner walls of the inner hollow space 420 of the back head 400, the bushing portion 110 of the chuck 120, thereby forming compressed-air chambers 220 and 250 between the piston and the casing.

The piston 200 also has a compressed air passageway 230 pierced from inlet aperture 232 which is formed between outer diameter R1 and R2 to outlet aperture 234 formed in outer diameter R3.

Figure 5:
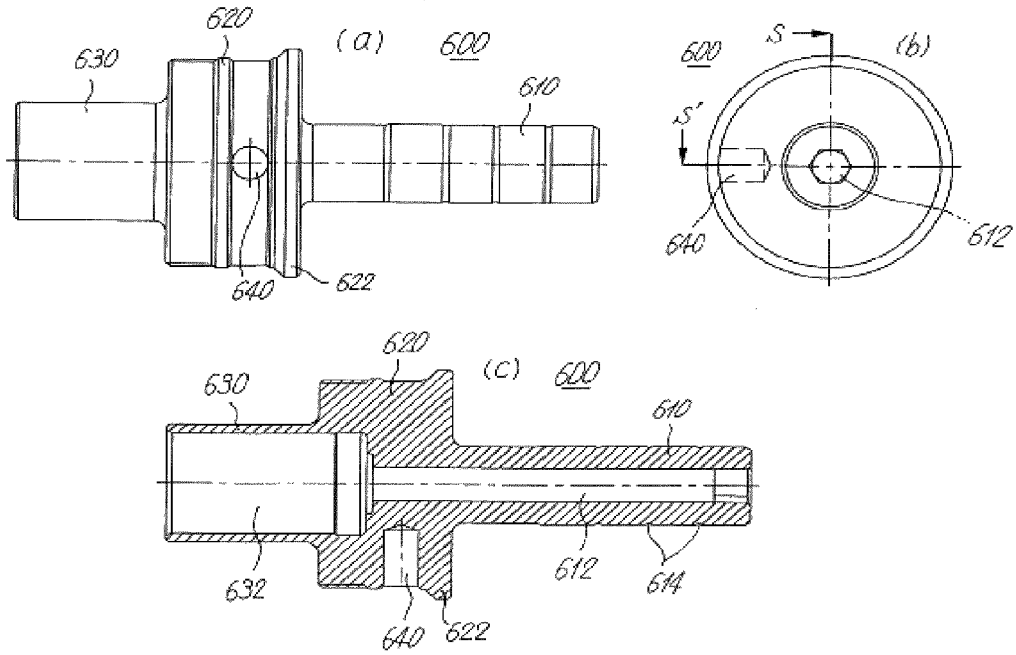
FIG. 5 is a view illustrating the construction of a guide 600 in FIG. 1, wherein FIG. 5(*a*) is a front view of the guide, FIG. 5(*b*) is a right side view of FIG. 5(*a*), and FIG. 5(*c*) is a cross-sectional view taken along the line S-S' of FIG. 5(*b*)

FIG. 5 is a view illustrating the construction of a guide 600 in FIG. 1, wherein FIG. 5(*a*) is a front view of the guide, FIG. 5(*b*) is a right side view of FIG. 5(*a*), and FIG. 5(*c*) is a cross-sectional view taken along the line S-S' of FIG. 5(*b*).

The guide 600 includes a shaft portion 610 that advances to and retracts from the inner hole 210 of the piston 200, an intermediate anvil portion 620, and a check valve receiving portion 630 formed at an upper end portion thereof, which have different outer diameters. In addition, the anvil portion 620 has a circumferentially extending outer peripheral edge portion 622 formed at a lower portion thereof and a stopper hole 640 formed on the outer peripheral surface thereof. The shaft portion 610 has a center through-hole 612 formed therein to fluidly communicate with a receiving hole 632 of the check valve receiving portion 630. The shaft portion 610 also has a plurality of annular grooves 614 axially formed on the outer peripheral surface thereof so that when it advances to and retracts from the center hole 210 of the piston 200, maximization of a sealing function and minimization of a frictional resistance are achieved simultaneously. Particularly, the circumferentially extending outer peripheral edge portion 622 of the anvil portion 620 inserted into the inner peripheral edge portion 430 so as to divide center hole 410 and inner hollow space 420 of the back head 400.

Figure 6:
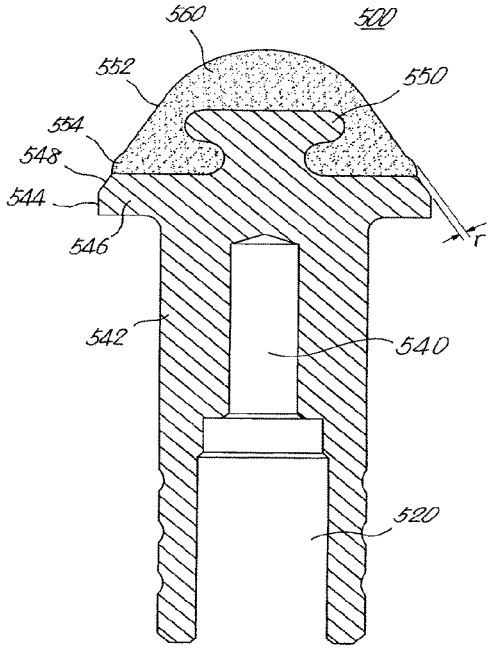
FIG. 6 is a cross-sectional view illustrating the construction of a check valve 500 in FIG. 1.

FIG. 6 is a cross-sectional view illustrating the construction of a check valve 500 in FIG. 1.

The check valve 500 has the following features as compared to a prior art check valve. The inventive check valve 500 includes a seating portion 542 formed with a center hole 520 and a inner hollow space 540 formed above the center hole, and a head portion 544 covered with an elastic rubber element 560. Particularly, the head portion 544 includes a skirt 546 having a slant surface 548 inclined upwardly toward its central axis at an upper end portion thereof. The head portion 544 also includes a support 550 having a diameter smaller than that of the skirt 546 and arranged horizontally above the skirt 546 in such a fashion as to be integrally spaced apart from the skirt by a certain distance, so that it has a rail-shaped cross sectional structure. In addition, the elastic rubber element 560 covered on the support 550 is contoured to have a slant surface 552 inclined at a angle parallel with the slant surface 548 of the skirt 546, and a reinforced strip portion 554 formed circumferentially at a lower end portion thereof in such a fashion as to be projected outwardly by a certain thickness (r) from a slant surface matching with the slant surface 552 of the elastic rubber element 560 and the slant surface 548 of the head portion 544.

Figure 7:
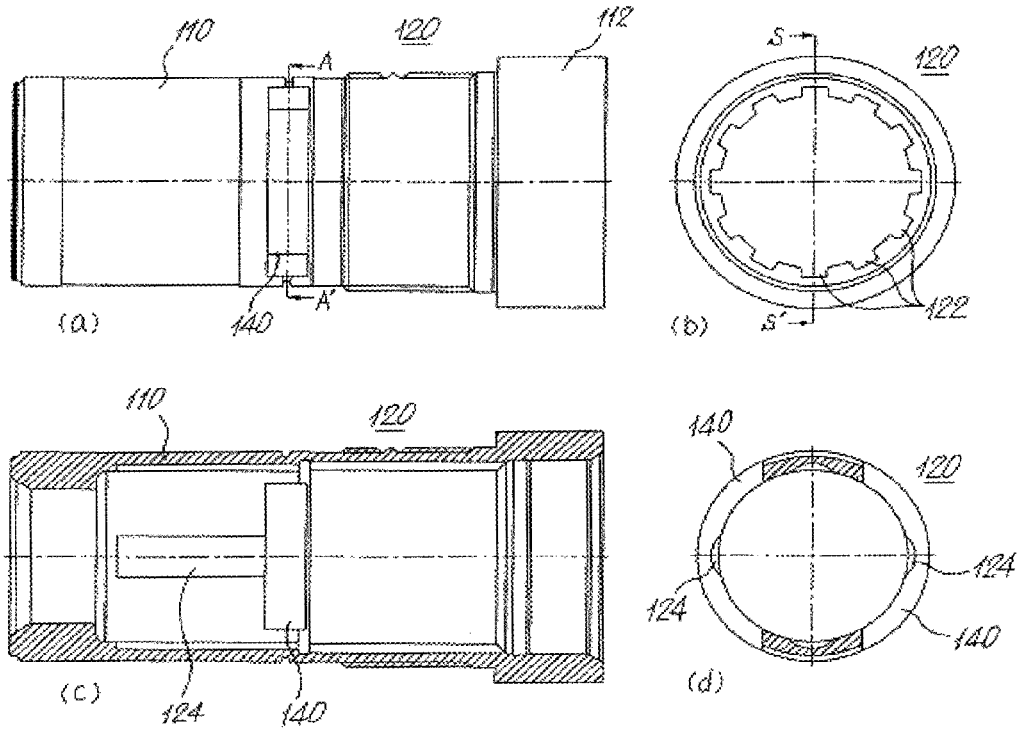
FIG. 7 is a view illustrating the construction of a drill chuck in FIG. 1, wherein FIG. 7(*a*) is a front view of the drill chuck, FIG. 7(*b*) is a right side view of FIG. 7(*a*), and FIG. 7(*c*) is a cross-sectional view taken along the line S-S' of FIGS. 7(*b*), and 7(*d*) is a cross-sectional view taken along the line A-A' of FIG. 7(*a*)

FIG. 7 is a view illustrating the construction of a drill chuck in FIG. 1, wherein FIG. 7(*a*) is a front view of the drill chuck, FIG. 7(*b*) is a right side view of FIG. 7(*a*), and FIG. 7(*c*) is a cross-sectional view taken along the line S-S' of FIGS. 7(*b*), and 7(*d*) is a cross-sectional view taken along the line A-A' of FIG. 7(*a*).

As shown in FIG. 7(*a*), the chuck 120 includes a bushing portion 110 and a casing contacting portion 112. An intermediate portion of the chuck 120 located between the bushing portion 110 and the casing contacting portion 112 has a bit retainer ring mounting recess 140 formed on the inner peripheral surface thereof and compressed air grooves 124 formed on the inner peripheral surface thereof (see FIG. 7(*c*), (d)). Also as shown in FIG. 7(*b*), the casing contacting portion 112 of the chuck 120 has a plurality of guide grooves 122 formed on the inner peripheral surface thereof in such a fashion as to be spaced apart from one another at regular intervals, so that the guide grooves 122 slidably engages with a plurality of circumferential protrusions alternately arranged between the adjacent guide grooves 340 of the button bit 300 in a concave-convex engagement relationship. FIG. 7(*c*) is intended to more easily show the formation of the bit retainer ring mounting recess 140 and the compressed air groves 124.

The respective components constituting the present invention as described above are assembled with one another in the positions as shown in FIG. 2 to implement the finished pneumatic operated hammer for rock drilling as shown in FIG. 1, and variable compressed-air chambers 220 and 250 are formed between the casing 100 and the piston 200 as in the driving process of FIG. 8 which will be described later.

Now, a non-explained structure and the driving process of the present invention according to a first embodiment as constructed above will be described hereinafter with reference to FIG. 8.

Figure 8:
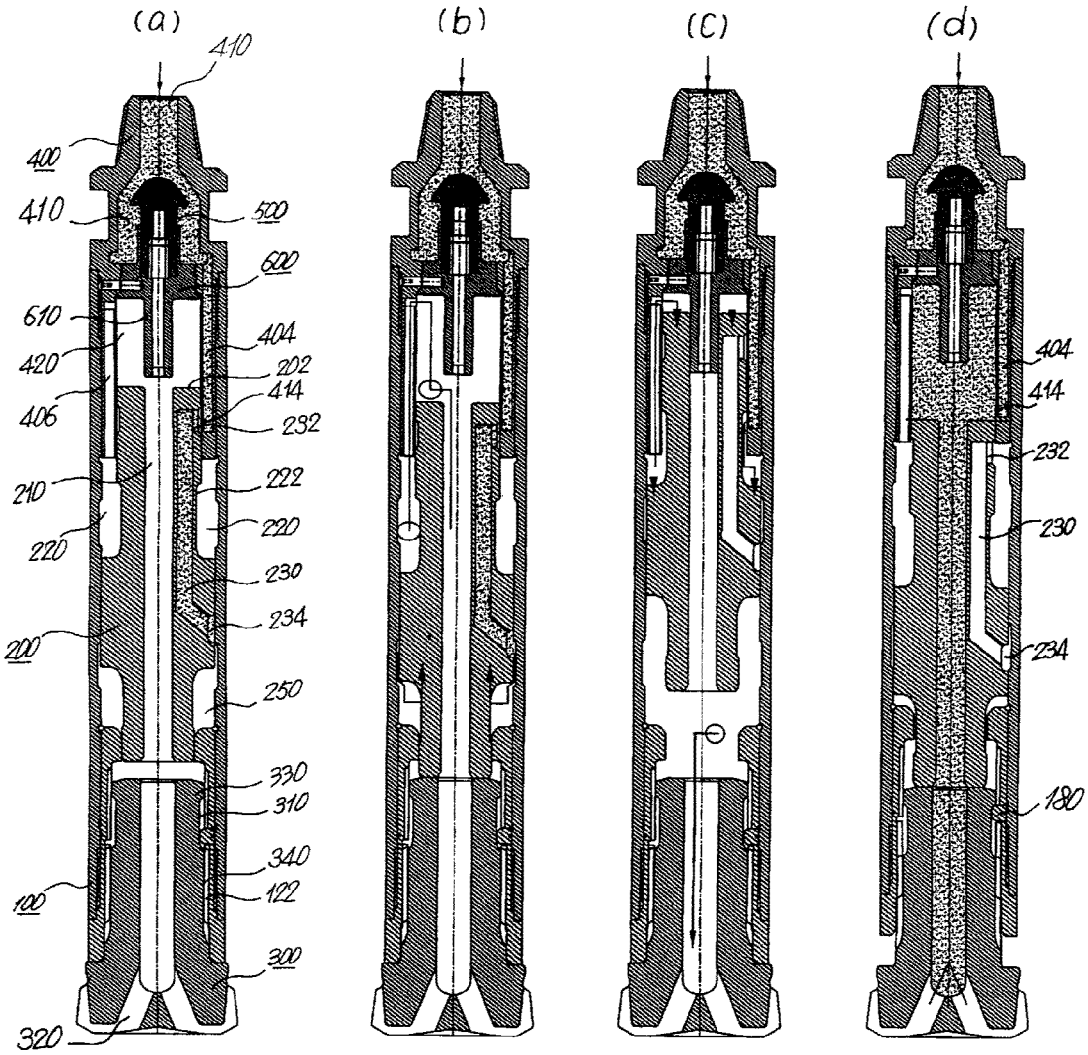
FIGS. 8(*a*) to 8(*d*) are cross-sectional views illustrating the sequential driving process of the pneumatic operated hammer for rock drilling according to the present invention of FIG. 1.

In FIG. 8, repetitive reference numerals are omitted if necessary for the sake of avoiding the confusion of the same reference numerals.

A hammer driving process in which the pneumatic operated hammer of the present invention performs rotation, striking and drilling is identical to that of the conventional prior art. Accordingly, the rotational force of the pneumatic hammer for rock drilling is generated in a known manner, and thus the explanation thereof will be omitted. As for the present invention, the striking force of the pneumatic hammer for rock drilling is generated where the compressed air is supplied to the inside of the casing through the center hole 410 of the back head 400 to descend the piston 200 to thereby strike the button bit 300, which will be described hereinafter by separate steps.

For the pneumatic operated hammer assembled as shown in FIG. (8*d*), the piston 200 and the button bit 300 are descended by their own weights in a load-free state, in which case compressed air (indicated by numerous points) is fed to the inside of the pneumatic hammer through the center hole 210 of the piston.

This operation is a first step of the driving process of the pneumatic operated hammer. The first step corresponds to a load-free step in which even if the pneumatic operated hammer which has prepared for a drilling work is supplied with compressed air, the drilling work is waited for, but not performed. In this load-free step, the compressed air supplied through the center hole 410 of the back head 400 overcomes the pressure of the check valve 500 and then is discharged to the outside along a compressed air flow channel running from the air passageway 404 and outlet aperture 414 via the center hole 210 of the piston to a discharge hole 320 of the button bit in a state where the piston 200 and the button bit 300 descend and are located at the lowermost position by their own weights, to thereby blow out sludge, etc., on the drilled surface without a striking effect.

A second step of the driving process of the pneumatic operated hammer corresponds to a step in which the piston 200 ascends. In this piston ascending step, when the pneumatic operated hammer descends until it reaches the drilling surface with the rotation force and the compressed air being supplied for the drilling work, as shown in FIG. 8(*b*), the button bit 300 and the piston 200 are pushed into the casing 100. At this time, the compressed air supplied to the center hole 410 from the outside by a compressor is fed to the first air passageway 404 and the inner hollow space 420 of the back head 400, and hence it is supplied to the compressed air passageway 230 via an inlet aperture 232 of the piston 200 fluidly communicating with the outlet aperture 414 of the air passageway 404.

The compressed air is upwardly and downwardly expanded in the compressed air chamber 250, but the piston 200 abuts against the button bit 300 and the lower end portion of the button bit 300 abuts against the drilling surface such that it does not descend any more. As a result, the compressed air is expanded in a direction where the piston 200 ascends to continue to ascend the piston 200. Accordingly, the compressed air passageways run to the compressed air chambers 250 defined by the hermetic sealing of the casing 100 and the lower end of the piston 200 so that the compressed air is supplied to the compressed air chambers 250 to expand the inside space of the compressed air chambers to thereby acceleratingly ascend the piston 200. At this time, the ascending of the piston continues to be performed until the outlet aperture 234 of the piston is blocked to interrupt the supply of the compressed air to the compressed air chambers 250 as shown in FIGS. 8(*b*) and 8(*c*).

During this ascending operation of the piston 200, the air within the compressed air chamber 220 passes through the inner hollow space 420 and the center hole 210 of the piston 200 through the second air passageways 406 of the back head and is discharged to the outside through the discharge hole 320 of the button bit 300 as indicated by arrow in FIG. 8(*b*), so that the prevention of the ascending of the piston 200, i.e., a compression effect does not occur in which when the piston 200 ascends, the air is pressurized within the compressed air chamber 220 to suppress the ascending of the piston 200. The piston 200 ascends to a predetermined vertex point by the ascending inertia as shown in FIG. 8(*c*) so that the shaft portion 610 of the guide 600 fits into the upper portion of the center hole 210 of the piston to block the discharge of the compressed air in the compressed-air chamber 220.

To describe briefly this operation, in the second step of the hammer driving process, the hammer bit descends for the drilling work and the bottom surface of the hammer bit comes in close contact with the drilling surface. In this case, when the hammer bit descends while rotating, the button bit 300 disposed at the lowermost position of the pneumatic operated hammer and the piston 200 are pushed into the inside of the casing 100. Thus, the compressed air flow channel of the second step is formed along following route; center hole 410, the first air passageway 404, outlet aperture 414 of the back head 400, inlet aperture 232, a compressed air passageway 230, outlet aperture 234 of the piston 200, inner diameter C3 of the casing 100 and the compressed air chamber 250 under the piston. Then, the piston 200 instantaneously ascends by the compressed air.

The third step of the hammer driving process is a striking step in which the piston 200 positioned at the vertex point descends. In the third step, as in the second step, when the piston 200 ascends along the inner wall surface of the inner hollow space 420 of the back head 400 at the portions having outer diameters R1, R2 thereof, and then an axial portion R having a smaller diameter between the outer diameters R2 and R3 reaches the outlet aperture 414 of the air passageway 404, the compressed air is introduced into the compressed air chamber 220 for the descending of piston through a clearance therebetween, i.e., a gap 222 formed due to a difference of different outer diameters R2 and R of the piston 200.

Accordingly, the space in the compressed air chamber 220 is expanded rapidly to generate an expanding force to thereby descend the piston 200. Simultaneously, the compressed air inside the compressed air chamber 220 is introduced into the inner hollow space 420 via the second air passageway 406 and the inlet aperture 412 and allows pressure to be applied to the top surface 202 of the piston 200, to thereby provide a dual striking force for aiding the descending force of the piston 200. When the piston 200 descends, the compressed air remained in the space defined by the bottom end of the piston, the top end of the button bit 300 and the inner wall of the casing 100 is discharged to the outside through the discharge hole 320 as shown in FIG. 8(*c*), so that it cannot function as a compression force for suppressing the descending of the piston 200.

Namely, the third step of the hammer driving process is a step in which the piston 200 descends in the casing 100 in a state where it positioned at the vertex point. In this third step, the compressed air is supplied through the center hole 410 is dually pressurized in the inner hollow space 420 defined by top surface 202 of the piston 200 and also in the compressed air chambers 220 so that the bottom end of the piston 200 strikes the top surface of the button bit 300 which will perform the drilling work.

Thus, the compressed air flow channel of the third step is formed along following route; the center hole 410, the first air passageway 404, outlet aperture 414 of the back head 400, a gap 222 of the piston 200, the compressed air chamber 250, and continuously the second air passageway 406, the inlet aperture 412 of the back head 400, inner hollow space 420 defined by top surface 202 of the piston 200.

Until the drilling work is completed, the second and third steps are repeatedly preformed to ascend and descend the piston 200. At this time, the drilling work is carried out by the vertical striking force of the piston and the rotational operation of the entire the pneumatic operated hammer.

In this case, as shown in FIG. 7, the button bit 300 ascends and descends at a guide portion thereof formed with the guide grooves 340 along the guide grooves 122 of the chuck 120 formed integrally with the bushing portion 110, but it is terminated at the outer circumferential groove 310 thereof by a retaining step 330 thereof so that the ascending and descending length of the button bit 300 is limited to the length of the outer circumferential groove portion 31 by the bit retainer ring 180.

In the meantime, since a so-called back-flow phenomenon occurs in which underground water, etc., is introduced backward into the casing 100 during the above continuous drilling work, there is the possibility for the back-flown water to block off the frictional surface of the piston and the compressed air chambers along with the sludge. The prevention of this requires that the length L of the piston 200 should be set to be more than 5.7 times that of a reference outer diameter R(L/R=5.7), and is set to be more than 3.2 times that of a portion having the largest outer diameter R3 (L/R=3.2).

Particularly, the piston 200 is formed with axial portions having different outer diameters R1, R2, R3 and R4 so that the axial portions are in close contact with the inner wall surface of the inner hollow space 420 of the back head 400 and the inner wall surface of the casing 100. Accordingly, the horizontal shaking of the piston is prevented during the ascending and descending of the piston to thereby assist in the upward linear movement without a clearance of the piston 200. This results in an efficient improvement over the moving lines of the air flow, so that the reciprocating speed of the piston is increased to thereby provide an effect of improving the drilling work efficiency.

In the meantime, the pneumatic operated hammer driving method according to the first embodiment of the present invention essentially requires the formation of the dual compressed air chambers that provides a rapid and strong striking force of the piston. In order to enhance the drilling working efficiency, a second embodiment of the present invention may be constructed within the scope of the present invention as follows. (although the constitutions of the first embodiment and the second embodiment of the present invention are identical to each other within an identical scope of the prevent invention, or components of similar structure are used, different reference numerals are used for the identical components for the sake of avoiding the confusion of the same reference numerals.

Figure 9:
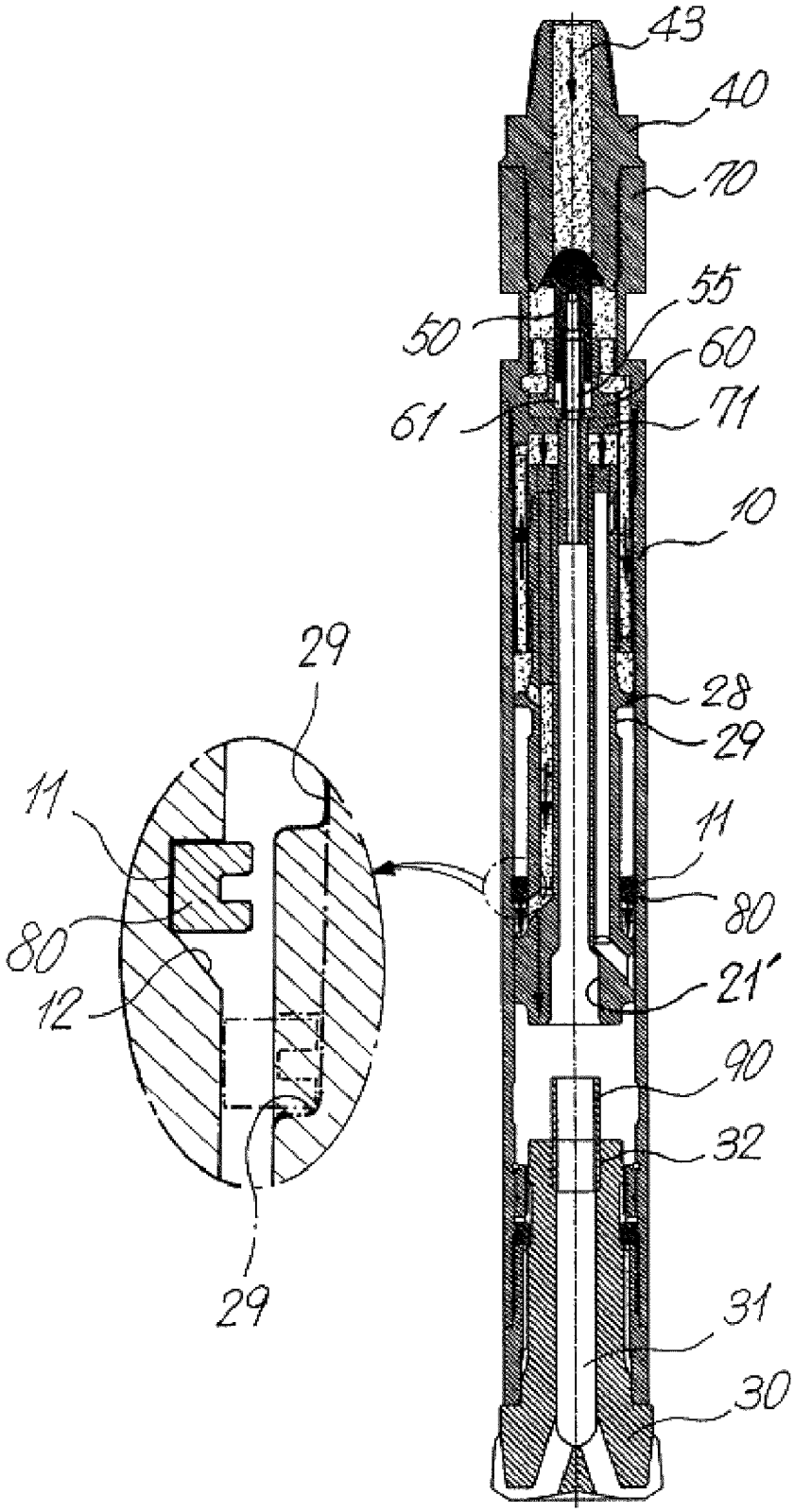
FIG. 9 is a cross-sectional view of a pneumatic operated hammer for rock drilling in an assembly state according to a second embodiment of the present invention.

As shown in FIG. 9, in a pneumatic operated hammer for rock drilling in an assembly state according to a second embodiment of the present invention, first, the back head 40 and the casing 10 are engaged with by means of a joint 70. The reason for this is that the joint 70 is formed with a guide seating portion 71 and a compressed air groove 72 so that the guide 60 is seated from the top to the bottom of the joint 70 in the drawing to prevent the generation of a clearance due to vibration during the drilling work.

Also, a striking guide groove extending from the center hole is formed between the inner hole 21 constituting the inner diameter of a piston 20 and the outer periphery of the piston. The piston has a first chamber partition wall 28 and a second chamber partition wall 28' positioned below the first chamber partition wall 28 protrudingly formed at the outer periphery thereof, and a sealing support ring mounting groove 29 formed just below the first chamber partition wall 28 for mounting a sealing support ring which will be described later.

In the meantime, the upper portion of the center hole 31 of a button bit 30 is formed with a support groove 32 having a diameter larger than that of the upper portion of the center hole 31 so that a center rod 90 is fixedly engaged with the support groove. The center rod 90 is fit into the striking guide groove 21' of the piston 20 at the time of descending of the piston 20 so that the piston 20 is guided to strike the button bit 30 at a precise position, and compressed air from the inner hole 21 of the piston is supplied via the center hole 31 of the button bit so that it is rapidly discharged along with sludge.

In addition, the casing 10 has a concave depression 11 formed at the inner peripheral surface of the intermediate portion thereof for mounting the sealing support ring 80 therein. The sealing support ring 80 is formed in a doughnut shape constructed of two symmetrical semi-circular pieces so as to functions as a piston ring within a cylinder.

Figure 10:
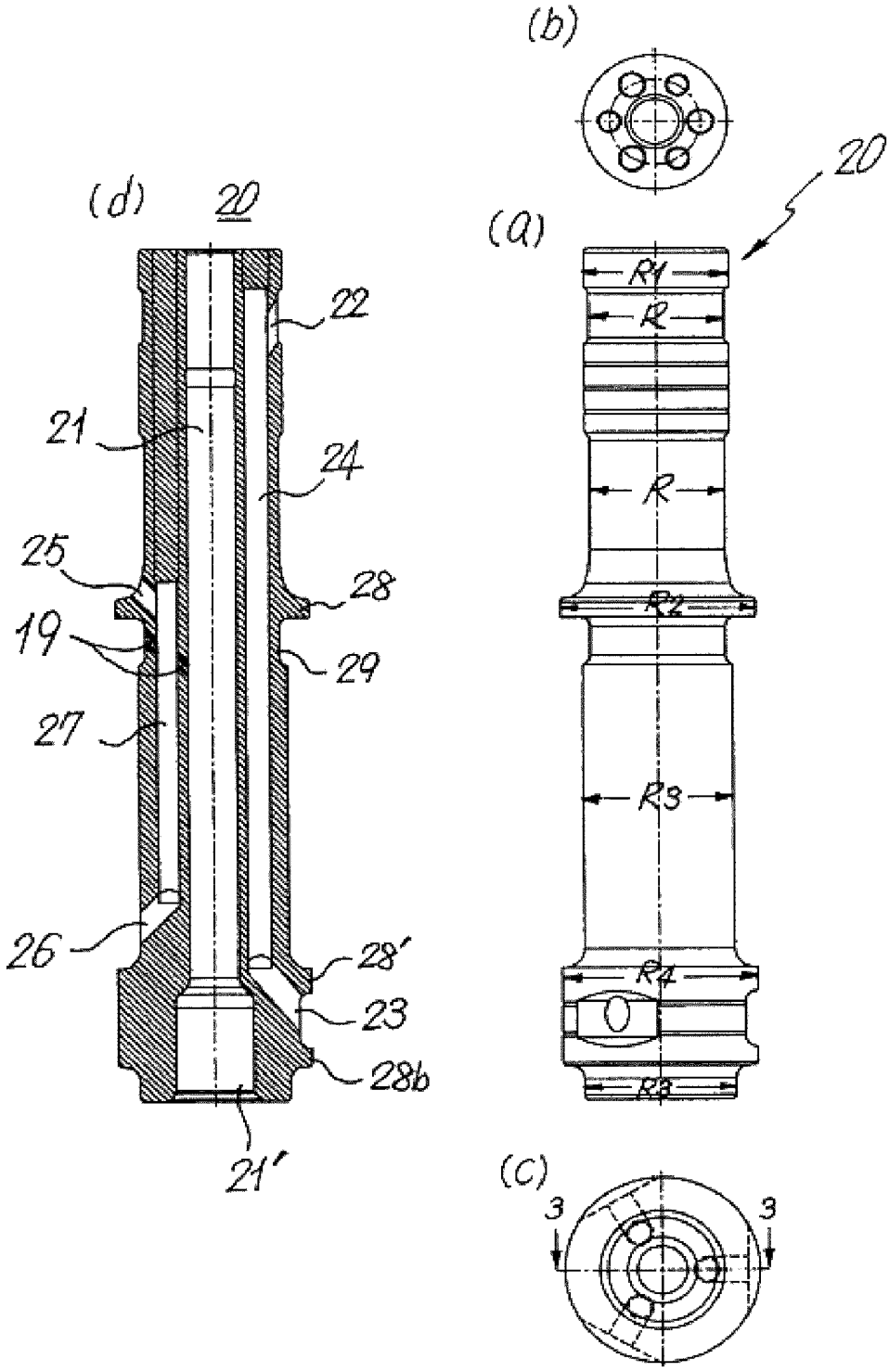
FIG. 10 is a view illustrating the construction of a piston 20 of FIG. 9, wherein FIG. 10(*a*) is a front view of the piston, FIG. 10(*b*) is a top plan view of FIG. 10(*a*), FIG. 10(*c*) is a bottom view of FIG. 10(*a*), and FIG. 10(*d*) is a cross-sectional view taken along the line 3-3' of FIG. 10(*c*)

FIG. 10 is a view illustrating the construction of a piston 20 of FIG. 9. The piston 20 has a center hole perforated therein. The piston consists of different axial portions having a reference diameter R and outer diameters R1, R2, R3 and R4 different from the reference diameter R. In this case, between the inner hole 21 of the piston 20 and the outer periphery of the piston are formed a pressure-increasing passageway 24 fluidly communicating with an inlet aperture 22 and an outlet aperture 23 and a pressure-reducing passageway 27 fluidly communicating with another inlet aperture 25 and another outlet aperture 26. A reference numeral 19 denotes a through-hole.

Figure 11:
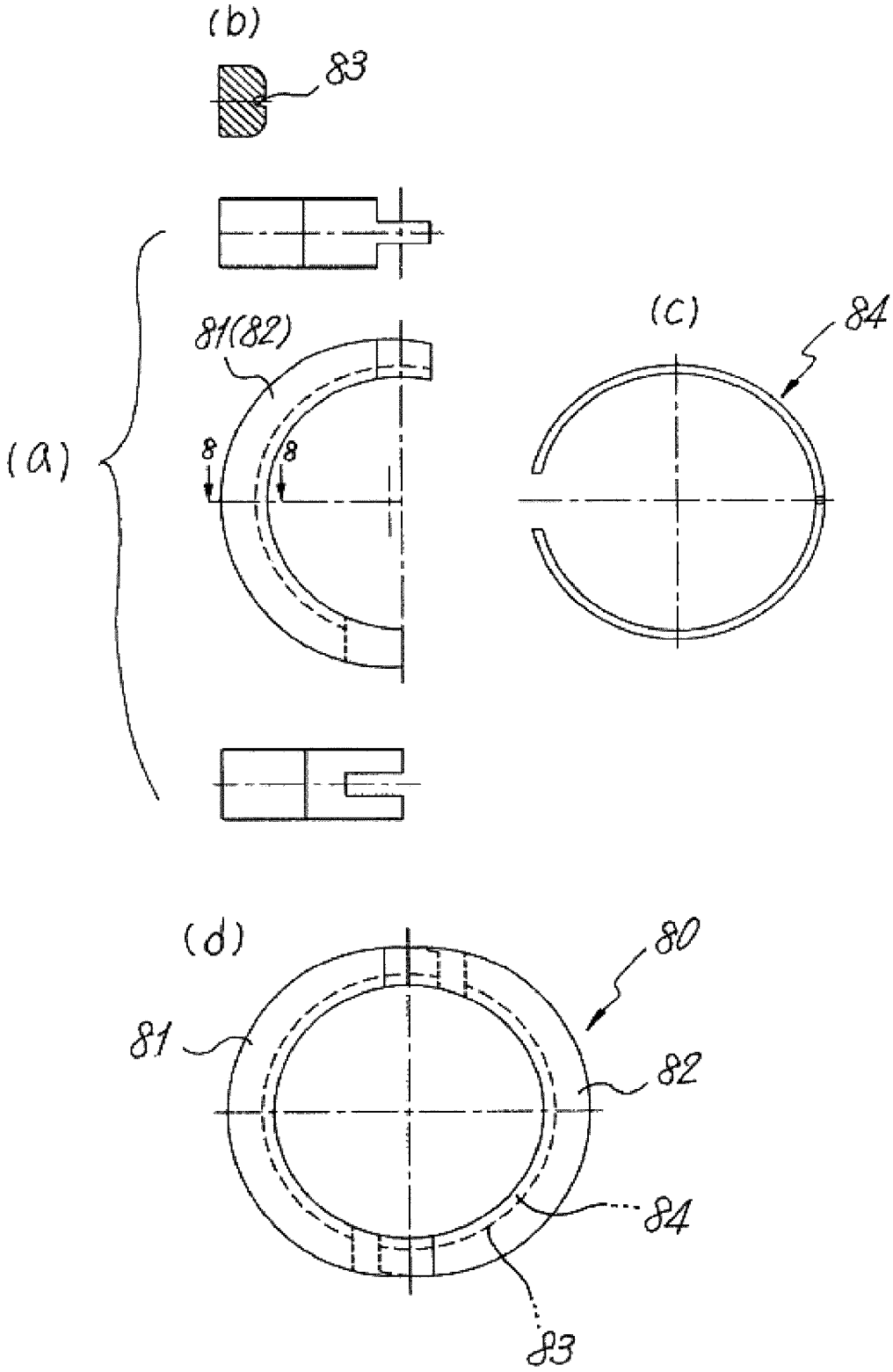
FIG. 11 is a view illustrating the construction of a sealing support ring, wherein FIG. 11(*a*) is a view of a semi-circular piece constituting the sealing support ring when viewed in the top, the front and the bottom, respectively, FIG. 11(*b*) is a cross-sectional view taken along the line 8-8' of FIG. 11(*a*), FIG. 11(*c*) is a view illustrating the construction of a tension spring, and FIG. 11(*d*) is a view illustrating the construction of a sealing support ring wherein the semi-circular piece of FIG. 11(*a*) is assembled in one pair.

FIG. 11 is a view illustrating the construction of a sealing support ring 80 received and mounted in the concave depression 11 of the casing 10. As shown in FIG. 11(*a*), a left semi-circular piece 81 and a right semi-circular piece 82 are engaged with each other to form an annular sealing support ring 80. In this case, the right and left semi-circular pieces 81 and 82 are engaged at both ends with each other in a concave-convex engagement relationship to form an annular dough-nut-shaped ring (see the upper and lower portions of a middle drawing FIG. 11(*a*)). As shown in FIG. 11(B), the sealing support ring 80 has a spring mounting groove 83 formed on the inner peripheral surface thereof for mounting a tension spring 84 therein as shown in FIG. 11(*c*) therein.

Figure 12:
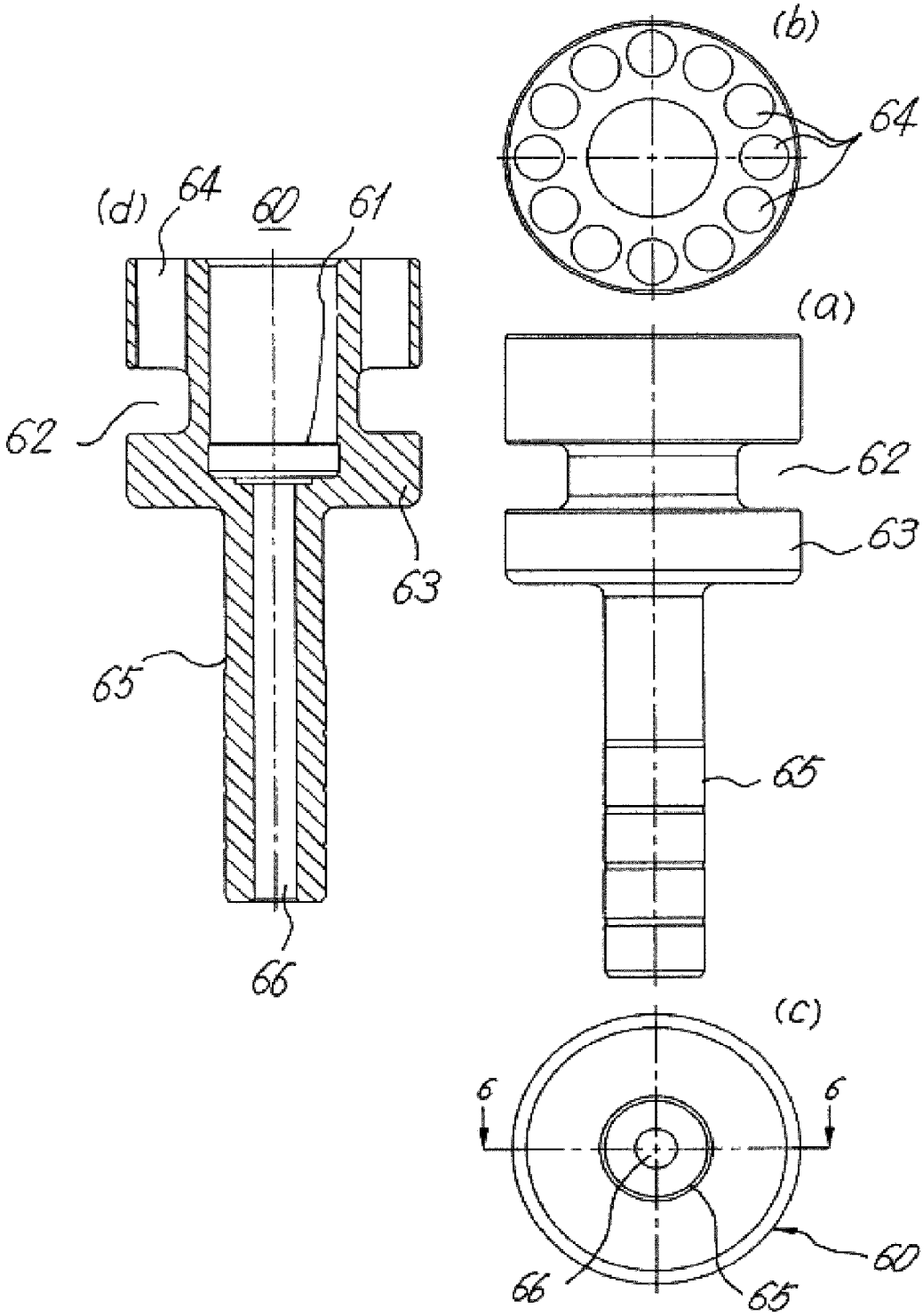
FIG. 12 is a view illustrating the construction of a guide of FIG. 9, wherein FIG. 12(*a*) is a front view of the guide, FIG. 12(*b*) is a top plan view of FIG. 12(*a*), FIG. 10(*c*) is a bottom view of FIG. 12(*a*), and FIG. 12(*d*) is a cross-sectional view taken along the line 6-6' of FIG. 12(*c*)

FIG. 12 is a view illustrating the construction of the guide of FIG. 9, wherein FIG. 12(*a*) is a front view of the guide, FIG. 12(*b*) is a top plan view of FIG. 12(*a*), FIG. 10(*c*) is a bottom view of FIG. 12(*a*), and FIG. 12(*d*) is a cross-sectional view taken along the line 6-6' of FIG. 12(*c*). In FIG. 12, the guide 60 has a spring seating portion 61 formed therein to constitute a body, a compressed air groove 62 formed on the outer peripheral surface thereof, and a seat portion 63 formed outwardly protrudingly on the outer peripheral surface thereof.

Also, the guide has a plurality of compressed air passageways 64 formed between the spring seating portion 61 and the outer periphery thereof, and a central axial rod 65 extending downwardly from the seat portion 63 to a predetermined length and formed internally with a center hole 66.

Particularly, the plurality of compressed air passageways 64 are arranged at regular intervals circumferentially on a circle having the common center with the guide as shown in FIG. 12(*b*). The compressed air passageways are not limited in number to the illustrated ones, but are differently formed depending on the size of the drilling equipment and the work purpose.

Figure 13:
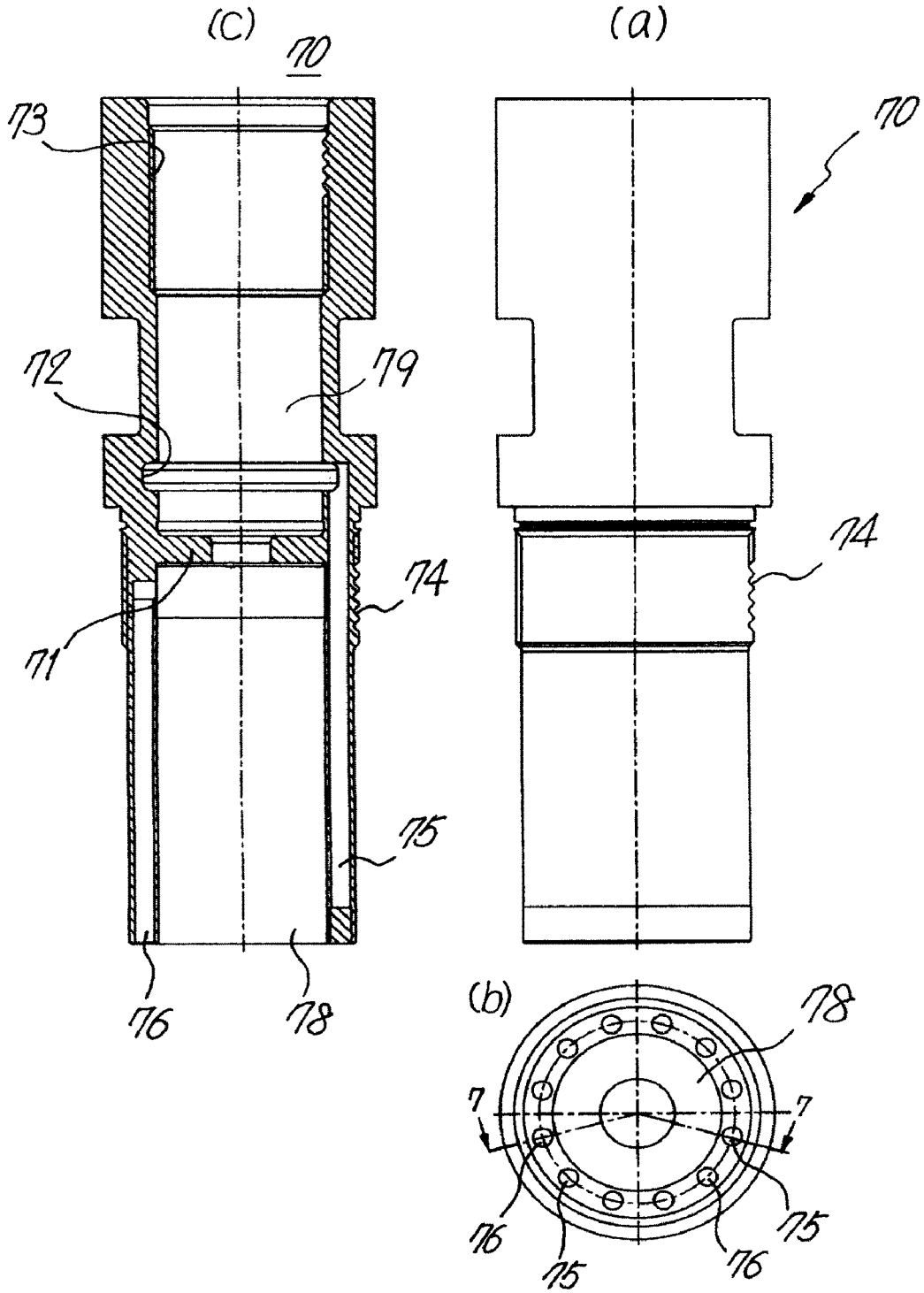
FIG. 13 is a view illustrating the construction of a joint of FIG. 9, wherein FIG. 13(*a*) is a front view of the joint, FIG. 13(*b*) is a bottom view of FIG. 13(*a*), and FIG. 13(*c*) is a cross-sectional view taken along the line 7-7' of FIG. 13(*b*)

FIG. 13 is a view illustrating the construction of a joint 70 of FIG. 9.

Figure 14:
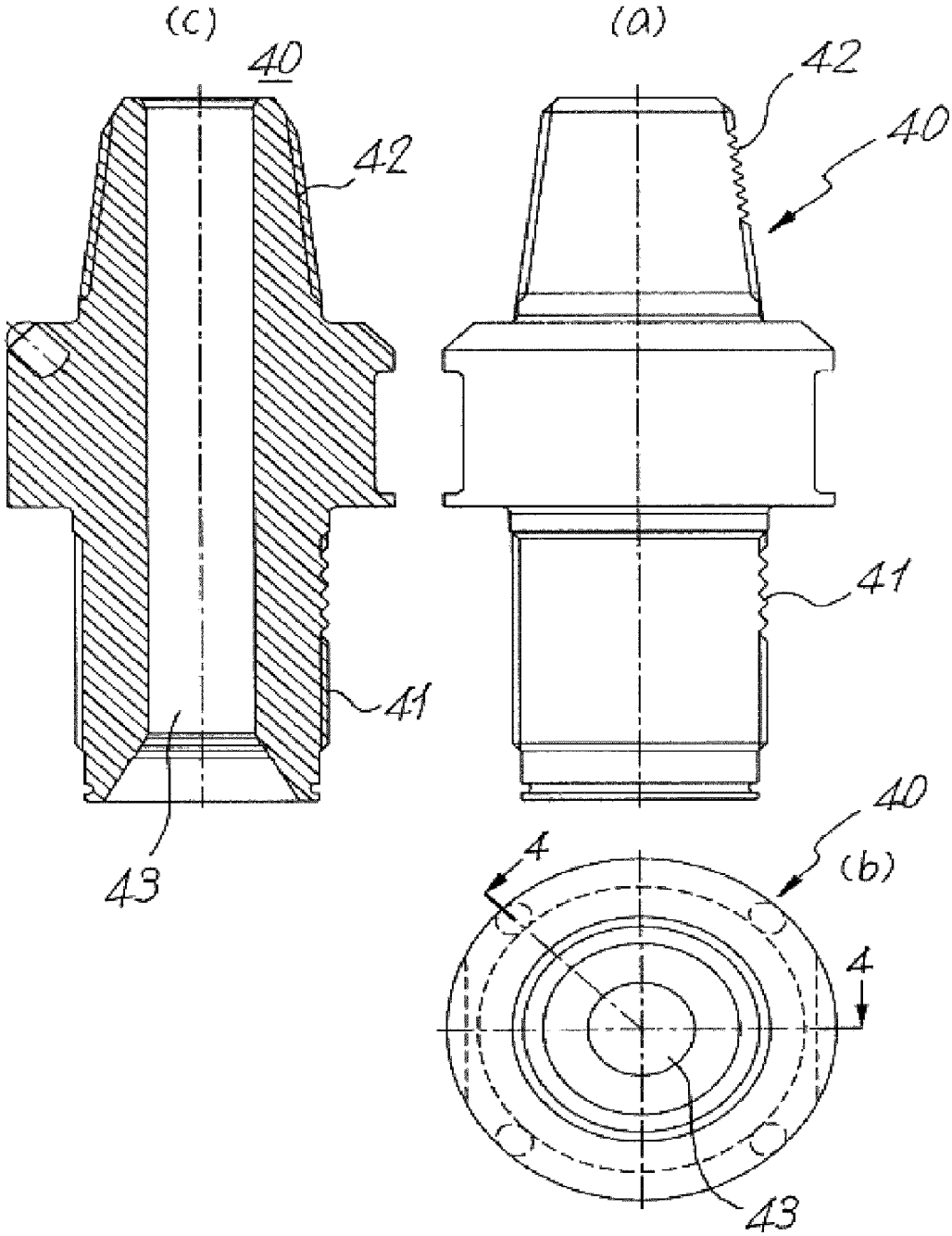
FIG. 14 is a view illustrating the construction of a back head of FIG. 9, wherein FIG. 14(*a*) is a front view of the back head, FIG. 14(*b*) is a bottom view of FIG. 14(*a*), FIG. 14(*c*) is a cross-sectional view taken along the line 4-4' of FIG. 14(*b*)

The joint 70 serves to engage the back head 40 as shown in FIG. 14 with the casing 10. As shown in FIGS. 13 and 14, the upper portion of the joint 70 has an inner spiral engagement section 73 formed on the inner peripheral surface thereof for allowing an outer spiral engagement section 41 of the back head 40 to be engaged therewith. The lower portion of the joint 70 has an outer spiral engagement section 74 formed on the outer peripheral surface thereof for allowing the upper portion of the casing 10 to be engaged therewith. As shown in FIG. 13(*c*), the joint has a structural characteristic in which a plurality of compressed air passageways 75, 76 are arranged at regular intervals circumferentially on the joint between the outer periphery of the joint and a center hole 78 of the joint. In addition, as shown in FIG. 14(*a*) showing a front view of the back head, FIG. 14(*b*) showing a bottom view of FIG. 14(*a*), and FIG. 14(*c*) showing a cross-sectional view taken along the line 4-4' of FIG. 14(*b*), the back head 40 has an outer engagement section 42 formed on the outer peripheral surface of a frusto-conical upper portion thereof, a center hole perforated therein, and an outer spiral engagement section 41 formed on the outer peripheral surface of a lower portion thereof for allowing the inner spiral engagement section 73 of the joint 70 to be engaged therewith.

In FIG. 9, respective components constituting the above configuration are assembled with one another. First, the piston 20 is inserted into the casing 10 in such a fashion that the sealing support ring 80 is positioned between the first chamber partition wall 28 and the second chamber partition wall 28' of the piston 20 while being elastically seated in the concave depression 11 of the casing. Also, the guide 60 is placed on the guide seating portion 71 of the joint 70 of FIG. 13 in a state where a check valve 50 elastically supported by a coil spring 55 is seated on the spring seating portion 61 of the guide 60. When the lower portion of the joint 70 is screw-engaged with the upper portion of the casing 10, the check valve 50 is configured such that a warhead-shaped front end portion blocks off the center hole 43 at the lower portion of the back head 40. But, the center hole 43 of the back head 40 always is not blocked off by the check valve 50. The coil spring 55 is designed to conform to a certain elastic force to open/close the check valve 50 depending on a degree of the compressed air. Thus, if the compressed air reaches less than a predetermined pressure, the check valve blocks off the center hole 43 of the back head 40 by an elastic force of the coil spring 55. On the other hand, the compressed air is larger than the elastic force of the coil spring 55, a compressed air passageway is formed to supply the compressed air therethrough.

In the meantime, the construction in which the button bit 30 is mounted at the lower portion of the casing 10 will be omitted since it is shown in FIG. 1.

A process in which the sealing support ring 80 is elastically seated in and then removed from the concave depression 11 of the casing 10 will be described hereinafter.

That is, after other component parts at the lower portion of the piston 20 have been first removed, when the piston 20 is pushed downwardly, the first chamber partition wall 20 downwardly pushes the sealing support ring 80. At this time, the cross section of the concave depression 11 of the casing 10 in which the sealing support ring 80 is accommodated, as enlarged by a circle in FIG. 9, is formed with a slant groove 12 so that the sealing support ring 80 slides downwardly along the slant groove and forcibly moved toward the piston 20. As a result, the sealing support ring 80 is slidably seated in the seating support ring mounting groove 29 formed on the outer peripheral surface of the piston 20 so that it is escaped from the lower end of the casing 10 together with the piston 20.

Figure 15:
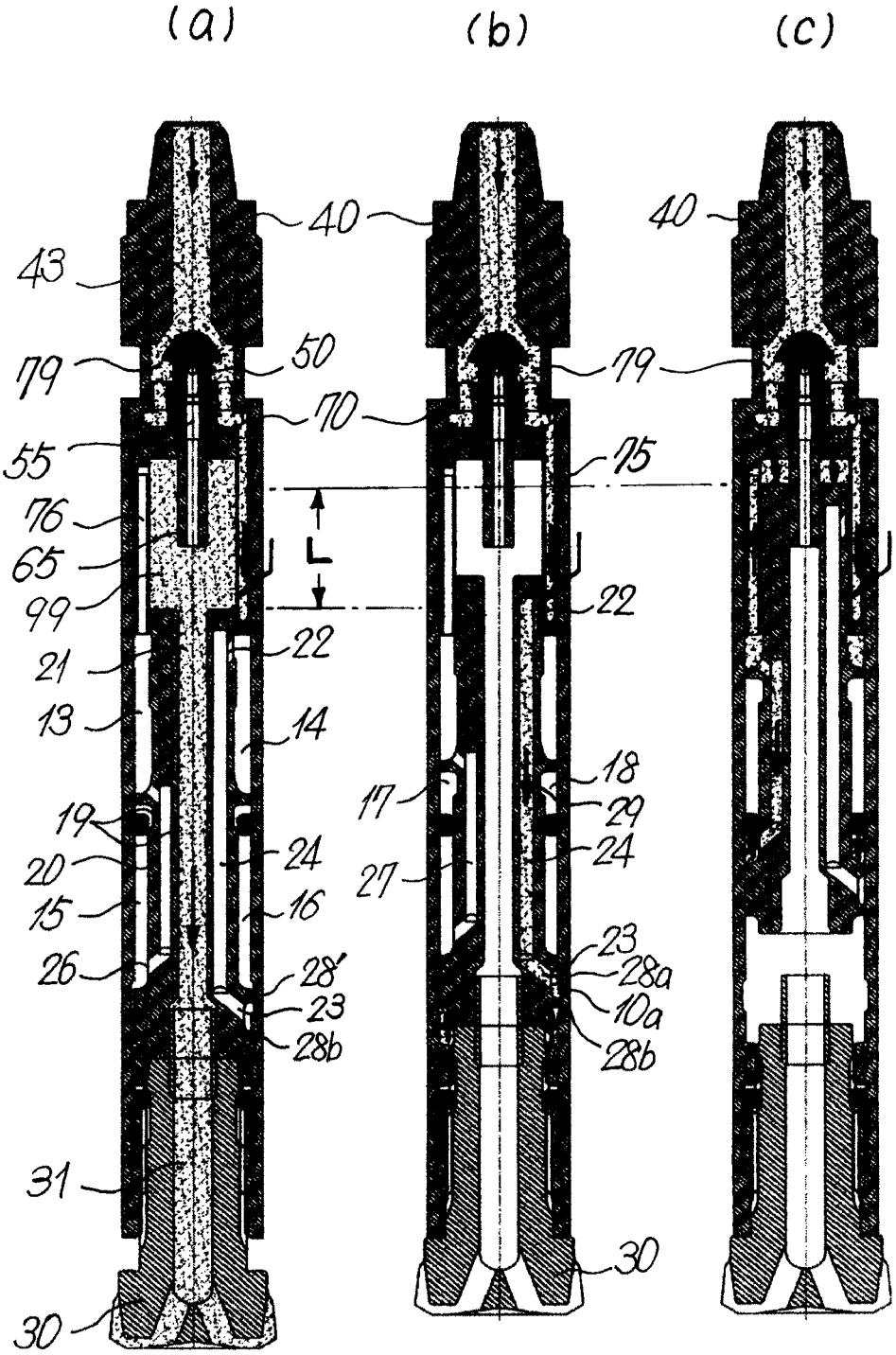
FIG. 15 is a cross-sectional view illustrating the operational state of the pneumatic operated hammer for rock drilling of FIG. 9 according to a second embodiment of the present invention, wherein FIG. 15(*a*) is a view showing the flow of compressed air for the drilling work before the operation of the pneumatic operated hammer, FIG. 15(*b*) is a view showing the flow of compressed air for the upward movement of the piston, and FIG. 15(*c*) is a view showing the flow of compressed air for the downward movement of the piston.

The drilling method in the second embodiment of the present invention as constructed above is identical to that in the first embodiment of the present invention. That is, in a first step, when the drilling work is prepared, as shown in FIG. 15(*a*), the piston and the button bit descend and are located at the lowermost position by their own weights so that although the compressed air is supplied to the pneumatic operated hammer, it is in a load-free state.

In a second step, an entire pneumatic operated hammer descends with it supplied with rotation and compressed air for the purpose of drilling earth/rock until it reaches the drilling surface. Then, as shown in FIG. 15(*b*), the button bit 30 and the piston 20 are pushed into the casing while forming chambers 13, 14, 15, 16, 17 and 18 divided by the first chamber partition wall 28 between the piston 20 and the casing 10.

In the meantime, the compressed air supplied by a compressor is supplied to an internal pressure chamber 79 formed inside the joint 70 via the center hole 43 of the back head 40 while pressing the check valve 50. At this time, the compressed air of the internal pressure chamber 79 is supplied to a compressed air passageway 75 formed in the joint 70.

In this case, since the piston 20 is placed in an ascended position where its inlet aperture 22 fluidly communicates with the compressed air chamber 79, the compressed air is supplied to a pressure-increasing chamber 28*a* via the pressure-increasing passageway 24 and the outlet aperture 23. The pressure-increasing chamber 28*a* is a variable space defined by a groove 10*a* formed on the inner peripheral surface of the casing 10 and a space formed between the second chamber partition wall 28' and a lower partition wall of the piston 20. Since high-pressure air continues to be introduced into the pressure-increasing chamber 28*a*, the space in the pressure-increasing chamber is expanded to upwardly push the piston 20.

When the piston 20 is upwardly pushed, the volume of the respective chambers 13, 14, 15 and 16 is reduced and the internal air of the piston 20 is supplied to the compressed air passageway 76 of the joint 70 in fluid communicating with the chamber 13 shown at the upper left portion in the drawing. Since the compressed air is discharged to the center holes 21, 31 through a piston pressurizing chamber 99, a compression phenomenon is prevented in which the volume of the chambers is reduced.

That is, an air compressing phenomenon is eliminated at a load-free state at the time of ascending the piston 20 so that the piston 20 can ascend at a very rapid speed.

However, although the intermediate chambers 17, 18 increases in volume to form a negative pressure, a through-hole 19 prevents the generation of the negative pressure. In the contrary, a phenomenon is prevented in which pressure increases due to an increase in volume of the intermediate chambers 17, 18.

In a third step, after the piston 20 reaches a vertex position of a piston ascending and descending length in which the ascending of the piston 20 stops, it strikes the button bit 30. In other words, the compressed air is supplied to the internal chamber 79, the compressed air passageway 75, and the upper right and left chambers 13, 14 in this order, and simultaneously it passes through the pressure-reducing chamber 27 of the piston 20 to be supplied to the lower right and left chambers 15, 16 via the outlet aperture 26, thereby generating pressure for instantaneously descending the piston 20. Accordingly, the piston 20 strikes the button bit 30 with its rapid and strong striking force.

As such, in the second embodiment of the present invention, one variable chamber is further formed between the casing and the piston, and the drilling hammer is manufactured by combining the component parts of the shape and structure which can form a compressed air passageway for supplying the compressed air to the variable chamber so that the drilling work can be performed by a rapid and strong striking force of the piston.

While the construction and operation of the first and second embodiment of the present invention has been designed on a large-capacity basis, a third embodiment of the present invention provides a pneumatic operated hammer for use in a medium and small-sized drilling work.

The drilling hammer according to the third embodiment of the present invention, as shown in FIG. 16 to FIG. 21, includes a back head 40*a* to which compressed air is supplied from the outside, a joint 70*a* for engaging the back head 40*a* with a casing 10*a* and having a guide member 71*a* inside thereof, a check valve 50*a* installed on the guide member 71*a* of the joint 70*a* for selectively interrupting the supply of the compressed air, a piston 20*a* adapted to ascend and descend within the casing 10*a* and having a plurality of compressed air passageways formed therein, and a button bit 30*a* mounted in such a fashion as to ascend and descend in the casing 10*a* for performing the drilling work through a descending striking force of the piston 20*a* and a rotational force of the casing 10*a*.

Figure 17:
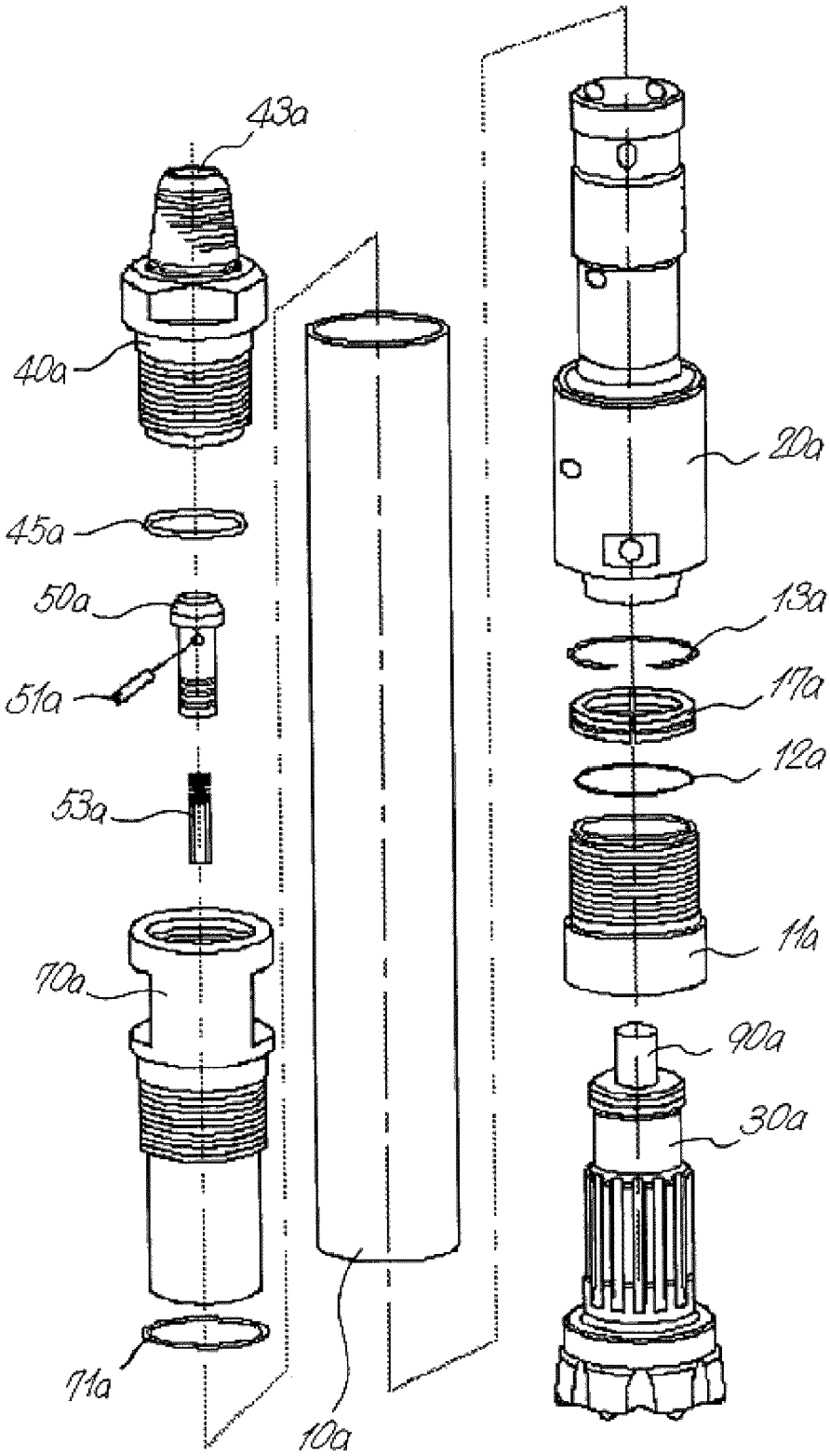
FIG. 17 is an exploded perspective view of FIG. 16.

FIG. 17 is an exploded perspective view of a pneumatic operated hammer for rock drilling according to a third embodiment of the present invention.

In FIG. 17, the back head 40*a* and the casing 10*a* are screw-engaged with each other by means of the joint 70*a*. The check valve 50*a*, which is located at the lower end of the center hole 43*a* of the back head and is elastically supported by a spring 53*a*, is supported by the inner periphery of the guide member 71*a* installed inside the joint 70*a*, so that the compressed air from the center hole 43*a* pushes the spring 53*a* downwardly to form a passageway for supplying the compressed air therethrough. Non-explained reference numerals 45*a* and 71*a* in FIG. 17 denote O-rings, 51*a* denotes a plug. In addition, as shown in FIG. 18, the piston 20*a* mounted at an intermediate portion of the casing 10*a* includes axial portions having different outer diameters R1, R2 and R3 so that it can strike the button bit 30*a*.

At the lower end of the casing 10*a* is mounted a chuck 11*a* together with a stop ring 13*a* for the piston 20*a*, a retainer ring 17*a* for the button bit 30*a*, an O-ring 21*a* so that the button bit 30*a* can ascend and descend along the inner periphery of the chuck 11*a*.

Figure 18:
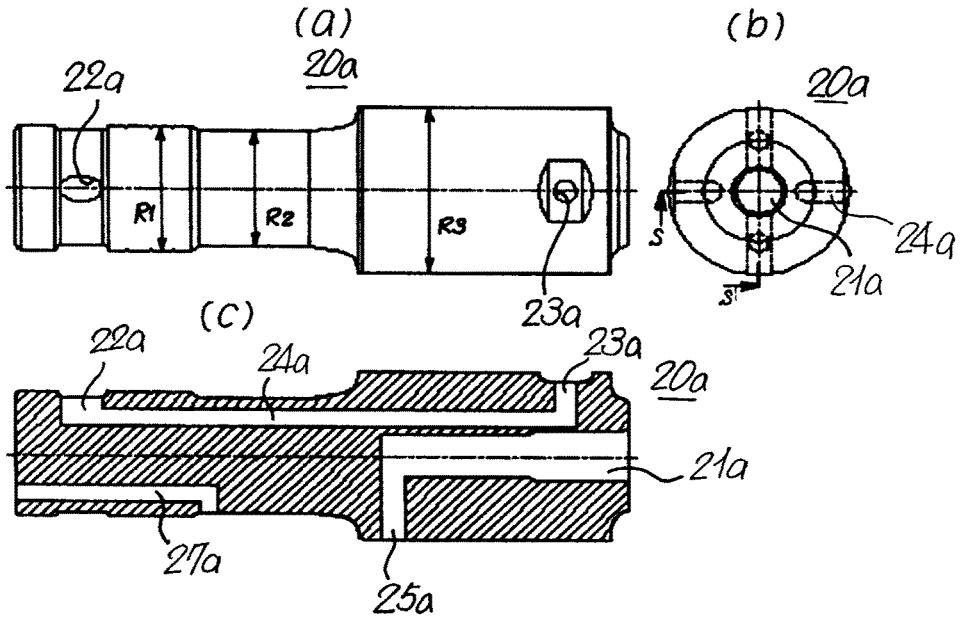
FIG. 18 is a view illustrating the construction of a piston in FIG. 16, wherein FIG. 18(*a*) is a front view of the piston, FIG. 18(*b*) is a right side view of FIG. 18(*a*), and FIG. 18(*c*) is a cross-sectional view taken along the line S-S' of FIG. 18(*b*)

FIG. 18 is a view illustrating the construction of a piston 20*a* of the pneumatic operated hammer according to the third embodiment of the present invention, wherein FIG. 18(*a*) is a front view of the piston, FIG. 18(*b*) is a right side view of FIG. 18(*a*), and FIG. 18(*c*) is a cross-sectional view taken along the line S-S' of FIG. 18(*b*). The piston 20*a* is a weight body including axial portions having different outer diameters R1, R2 and R3. The piston 20*a* has the first a compressed air passageway 24*a* formed therein in such a fashion as to fluidly communicate with an inlet aperture 22*a* opened toward upper side thereof and an outlet aperture 23*a* opened toward lower side thereof, a center hole 21*a* formed from another inter aperture 25*a* opened toward middle side thereof to the bottom surface of the piston, and the second compressed air passageway 27*a* formed therein from the top surface thereof to a opening in middle side of the piston. The outlet aperture 23*a*, as shown in FIG. 18(*b*), is formed in all directions about a central axis of the piston so that the compressed air passageway 24*a* is formed radially.

Figure 16:
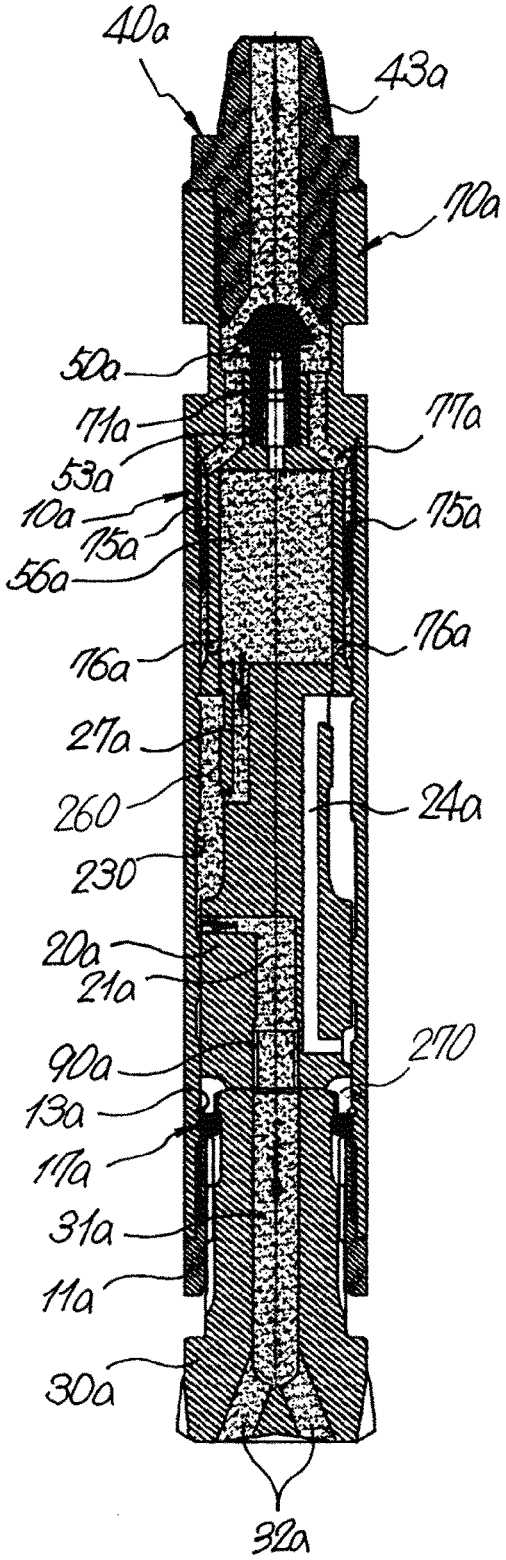
FIG. 16 is a cross-sectional view of a pneumatic operated hammer for rock drilling in an assembly state according to a third embodiment of the present invention.
Figure 19:
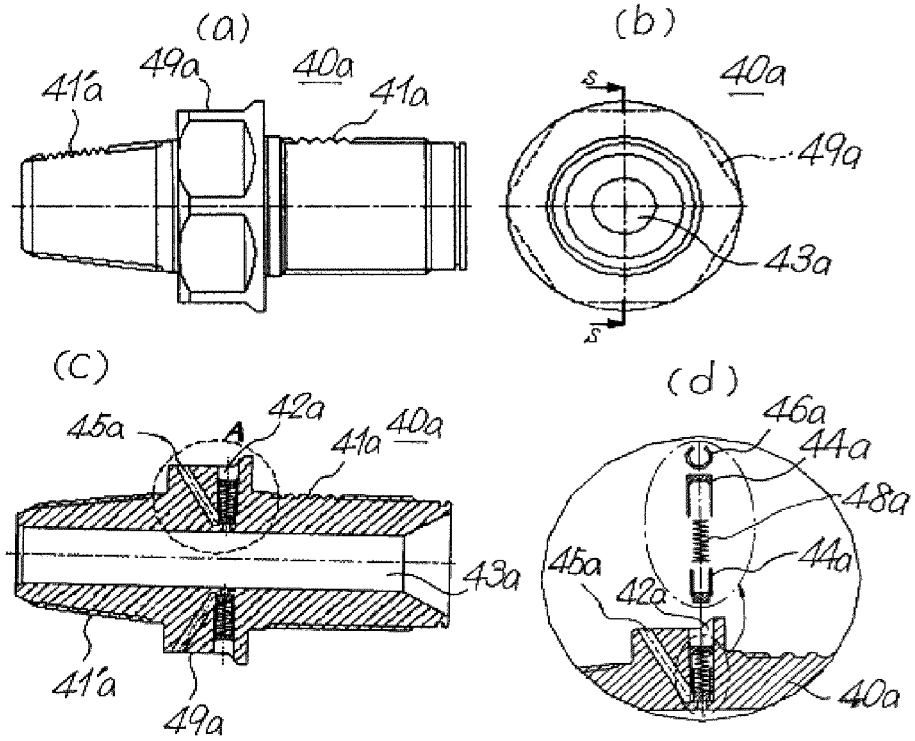
FIG. 19 is a view illustrating the construction of a back head of FIG. 16, wherein FIG. 19(*a*) is a front view of the back head, FIG. 19(*b*) is a right side view of FIG. 19(*a*), FIG. 19(*c*) is a cross-sectional view taken along the line S-S' of FIG. 19(*b*), and FIG. 19(*d*) is an enlarged view of a portion A in FIG. 19(*c*)

FIG. 19 is a view illustrating the construction of a back head of FIG. 16, wherein FIG. 19(*a*) is a front view of the back head in which its appearance forms a warhead shape, FIG. 19(*b*) is a right side view of FIG. 19(*a*), FIG. 19(*c*) is a cross-sectional view taken along the line S-S' of FIG. 19(*b*), and FIG. 19(*d*) is an enlarged view of a portion A in FIG. 19(*c*).

In FIG. 19, the back head 40*a* has spiral engagement sections 41*a*, 41*a*' formed on the outer peripheral surfaces of the upper portion and the lower portion thereof so as to engage with other components, and a nut portion 49*a* formed on the outer periphery of an intermediate portion thereof. The back head 40*a* has a center hole 43*a* formed therein for supplying compressed air therethrough.

Also, the nut portion 49*a* has a component assembling hole 42*a* and a bypass hole 45*a* formed therein in such a fashion as to fluidly communicate with the center hole 43*a*. A valve 44*a* is elastically supported by a spring 48*a* in the component assembling hole 42*a* and is terminated by a snap ring 46*a*. Thus, in the case where there is a limitation in treating sludge only with compressed air consumed in the pneumatic hammer upon the high-level drilling work, the compressed air is discharged to the outside through the bypass hole 45*a* so as to facilitate the treatment of the sludge and obtain an effect of enhancing a penetration rate. In the meantime, the nut portion 49*a* is formed in a hexagonal shape in the FIG. 19, but is not limited thereto. Also, other components may be formed in a symmetrical position as shown in FIG. 19(*c*) along with the bypass hole 45*a* or may be formed at respective hexagonal corners of the nut portion 49*a*.

Figure 20:
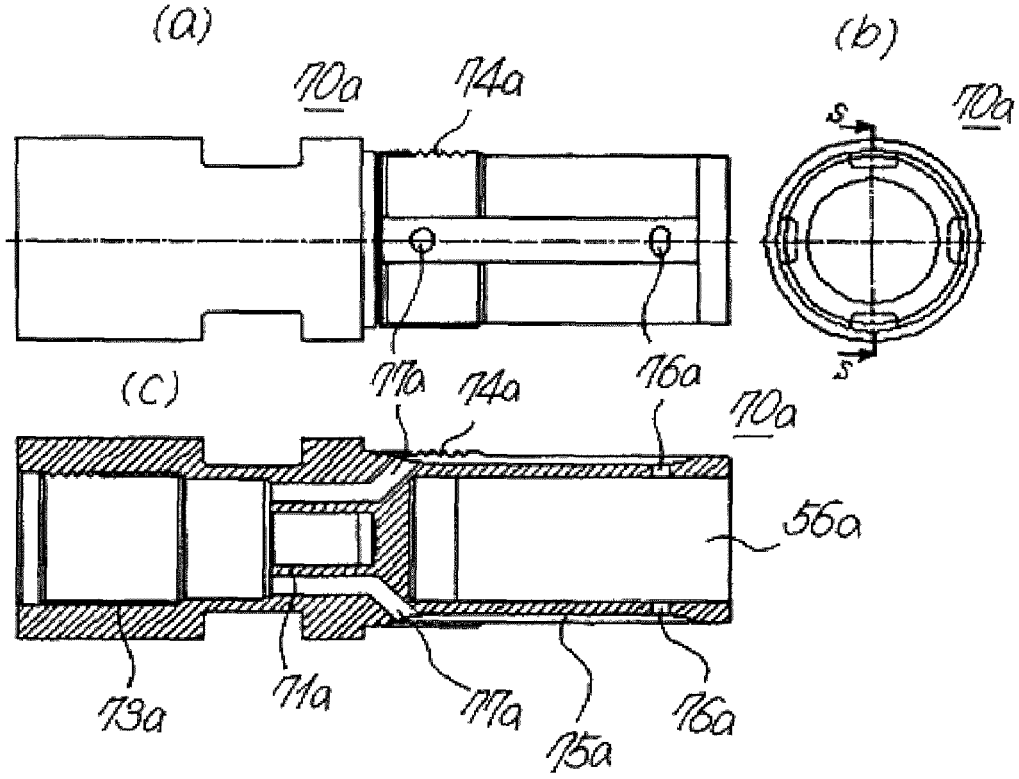
FIG. 20 is a view illustrating the construction of a joint of FIG. 16, wherein FIG. 20(*a*) is a front view of the joint, FIG. 20(*b*) is a right side view of FIG. 20(*a*), and FIG. 20(*c*) is a cross-sectional view taken along the line S-S' of FIG. 209(*b*)

FIG. 20 is a view illustrating the construction of a joint 70*a* of the pneumatic operated hammer according to the third embodiment of the present invention, wherein FIG. 20(*a*) is a front view of the joint, FIG. 20(*b*) is a right side view of FIG. 20(*a*), and FIG. 20(*c*) is a cross-sectional view taken along the line S-S' of FIG. 20(*b*).

Referring to FIG. 20, the joint 70*a* includes an inner spiral engagement portion 73*a* formed on the inner peripheral surface of an upper portion thereof for allowing the outer spiral engagement portion 41*a* of the back head 40*a* to be engaged therewith, and an outer spiral engagement portion 74*a* formed on the outer peripheral surface of a lower portion thereof for allowing the upper end portion of the casing 10*a* to be engaged therewith. In addition, the joint 70*a* includes a guide member 71*a* dividing inner hollow space of the joint 70 into two parts of the upper and the lower portion, and a compressed air inlet aperture 77*a* is formed between the guide member 71*a* and the outer periphery of the joint 70*a* to thereby form a compressed air passageway 75*a* between the joint 70*a* and the casing 10*a*, and the compressed air passageway 75*a* fluidly communicating with a compressed air outlet aperture 76*a* formed inward in the lower portion of the joint 70*a*. The cross-section of the drilling pneumatic hammer according to the third embodiment of the present invention in which above components are assembled with one another and finished is shown in FIG. 16.

In FIG. 16, the drilling pneumatic hammer is vertically oriented for the purpose of the drilling work. The back head 40*a* is engaged with the joint 70*a*, and the check valve 50*a* is seated in the guide member 71*a* of the joint 70*a* with it elastically supported by the spring 53*a*. The compressed air passageway 75*a* is formed between the joint 70*a* and the casing 10*a* in a state where the joint 70*a* has been screw-engaged with the casing. In addition, the joint 70*a* is formed in a cylindrical shape to form a compressed air chamber 56*a* inside the lower portion thereof, and the air chamber 56*a* is fluidly communicating with the air passageway 75*a* via the air outlet aperture 76*a*.

Meanwhile, a variable compressed air chamber 260 is formed between the casing 10*a* and the piston 20*a* so as to fluidly communicate with the second compressed air passageway 27*a* of the piston 20*a*, and another variable compressed air chamber 270 is formed below the piston 20*a* so as to fluidly communicate with the first compressed air passageway 24*a* of the piston 20*a*. Also, the compressed air inlet aperture 25*a* of the piston 20*a* forms a compressed air passageway together with an inner diameter groove 230 formed by varying the thickness of the casing 10*a*. The center hole 21*a* of the piston 20*a* is formed in such a fashion that a lower portion thereof is larger in diameter than an upper portion thereof to allow a shaft 90*a* mounted on the button bit 30*a* to be fit thereto. Further, the stop ring 13*a* for the piston and the retainer ring 17*a* for the button bit are assembled along with the chuck 11*a* without a clearance of the button bit 30*a* so that the striking operation due to the ascending and descending of the piston can be performed. In addition, a center hole 31*a* is centrally formed in the button bit so that when the center hole 31*a* fluidly communicates with the center hole 21*a* of the piston 20*a*, the compressed air is discharged to the outside via a discharge hole 32*a* to thereby blow out sludge.

Figure 21:
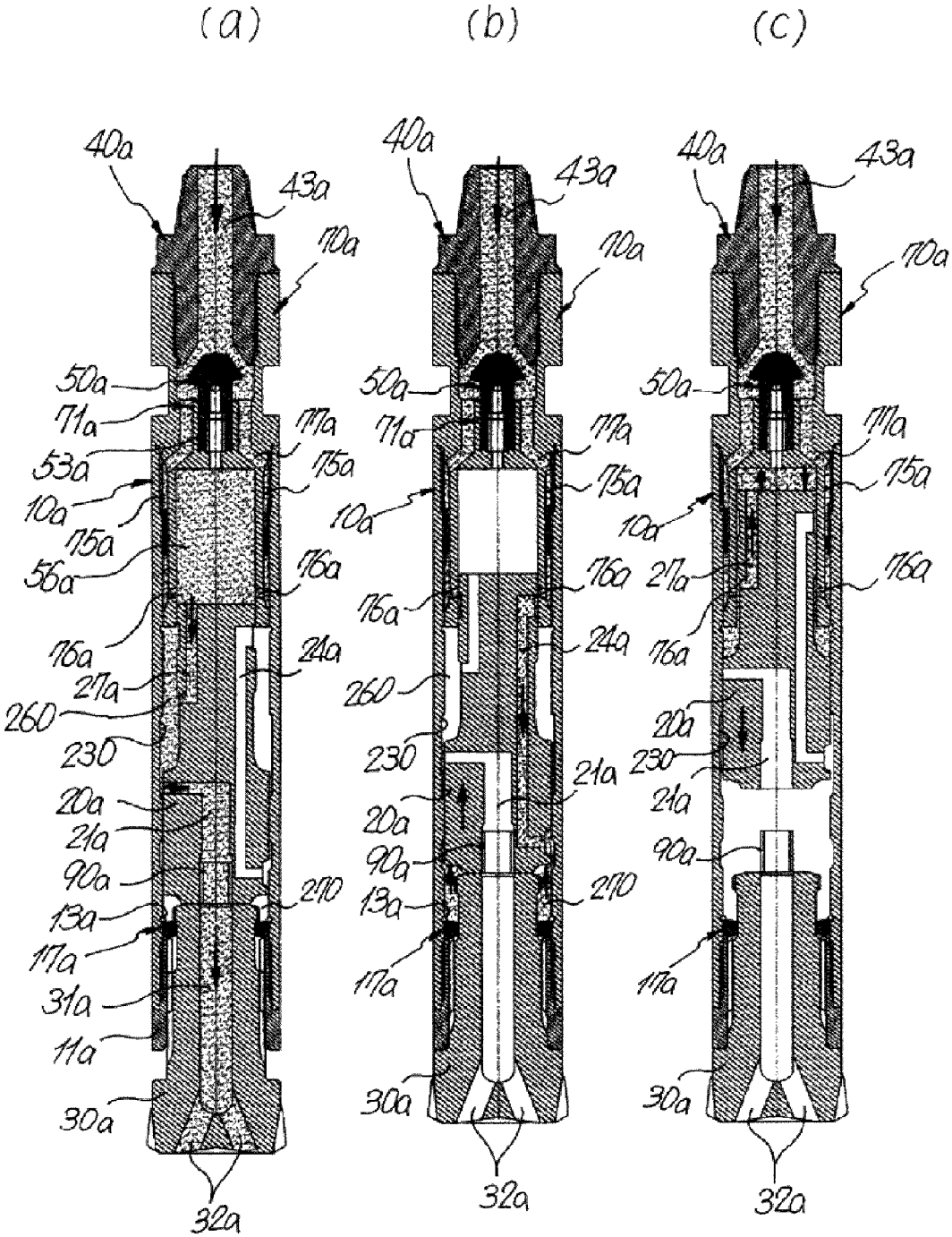
FIG. 21 is a cross-sectional view illustrating the operational state of the pneumatic operated hammer for rock drilling of FIG. 16 according to a third embodiment of the present invention, wherein FIG. 21(*a*) is a view showing the flow of compressed air for the drilling work before the operation of the pneumatic operated hammer, FIG. 21(*b*) is a view showing the flow of compressed air just before the ascending of the piston, and FIG. 21(*c*) is a view showing the flow of compressed air for the striking at a stop point after the ascending of the piston.

The driving process of the drilling pneumatic hammer according to the third embodiment of the present invention is shown in FIG. 21. The drilling operation in which the piston 20*a* downwardly strikes the button bit 30*a* by means of the compressed air while the pneumatic hammer rotates is identical to that in the first and second embodiments.

As shown in FIG. 21(*a*), in the hammer that is prepared for the drilling work, the piston 20*a* and the button bit 30*a* descend by their own weights. At this time, the compressed air flows along a discharge passageway formed in one direction as indicated by a sold arrow. When the drilling work begins, as shown in FIG. 5(*b*), the bottom end surface of the button bit 30*a* comes into close contact with the drilling surface (not shown) while entire hammer ratatably descends so that the button bit 30*a* is inserted into the inside of the casing 10*a*. Such a drilling operation is also identical to that in other embodiments.

The compressed air supplied to the pneumatic hammer from the outside for the purpose of the drilling work passes through the center hole 43*a* and pressurizes the check valve 50*a*. Thereafter, the compressed air is transported to the compressed air inlet aperture 77*a* formed between the guide member 71*a* and the outer periphery of the joint 70*a*. At this time, the compressed air continues to be supplied to the piston until its pressure exceeds the elastic force of the support spring 53*a*. When the check valve 50*a* is shut off, the back flow of the compressed air is prevented so that the check valve 50*a* can perform a function of supplying the compressed air in one direction.

The compressed air introduced into the center hole 43*a* of the back head, as shown in FIG. 21(*b*), passes through the compressed air passageway 75*a* defined by a space between the inner periphery of the casing 10*a* and the outer periphery of the guide member 71*a* via the compressed air inlet aperture 77*a* of the joint 70*a*, and then is fed to the compressed air outlet aperture 76*a* to be supplied to the compressed air chamber 270 through the first compressed air passageway 24*a* of the piston 20*a*. An increase in pressure of the compressed air expands the compressed air chamber 270 formed below the piston 20*a*, whereas the compressed air in another compressed air chamber 56*a* closed by top surface of the piston is discharged to the outside via the second compressed air passageway 27*a*, the variable compressed air chamber 260, the center hole 21*a* and the center hole 31*a* in this order. Therefore an ascending suppression of the piston 20*a* due to the remaining compressed air in the hammer is prevented.

As such, the compressed air that expands the compressed air chamber 270 below the piston, as shown in FIG. 21(*c*), continues to be supplied to the piston until the piston 20*a* ascends to the vertex point. When the compressed air inlet aperture 77*a*, the compressed air outlet aperture 76*a* and the second compressed air passageway 27*a* are fluidly communicate with one another, as shown in FIG. 21(*c*), the area of the compressed air chamber 56*a* above top surface of the piston abruptly increases to thereby abruptly descend the piston 20*a* due to the instantaneous pressure. Such a continuous striking of the piston due to the ascending and descending of the piston 20*a* allows the button bit 30*a* to perform the drilling work.

As described above, the pneumatic operated hammer of the third embodiment of the present invention is designed such that the piston can ascend and descend through the conversion of the compressed air passageway and the pressure variation of the compressed air chamber. Accordingly, the number of component pars is reduced, the drilling work efficiency is enhanced due to simplicity of the structure, and the time and cost required for maintenance and repair of the drilling equipment is greatly saved.

INDUSTRIAL APPLICABILITY

As set forth in the foregoing, the compressed air required for the drilling work is supplied to the piston through air passageways arranged at regular intervals circumferentially on a circle having the common center with the inner hollow space of the back head, and is expanded in the compressed air chambers to thereby ascend and descend the piston. The present invention has a merit in that through such a simple operation principle, an efficiency of the drilling work is significantly enhanced to thereby facilitate maintenance and repair of the drilling equipment and save the time and cost required for the drilling work.

Particularly, a conventional prior art pneumatic operated hammer has a demerit in that when the piston ascends by the compressed air, the compressed air chambers are pressurized to apply a load that suppresses the ascending of the piston. However, the present invention has an advantageous effect in that since the compressed air is supplied to the hammer in a load-free state without any pressurization of the compressed air chamber at the time of ascending the piston, the piston abruptly ascends and its striking force is increased by the compressed air effected in the variable compressed air chambers even upon the descending of the piston.

Further, the piston is designed for prevention of the back flow of water such that a second chamber partition wall is formed in the piston, the inner space thereof extends to the outlet aperture to form the pressure-increasing passageway, thereby performing more rapid ascending operation of the piston. In addition, when the ascending operation is switched to the descending operation, the compressed air instantaneously descends the piston to thereby obtain a striking force increased upon the rapid ascending and descending of the piston so as to further improve the speed of the drilling work.

Furthermore, it is possible to utilize a small-capacity drilling hammer or a medium and large-capacity drilling hammer depending on the work scale, thereby improving the drilling work efficiency and saving the time and cost required for the maintenance and repair of the drilling equipment.

While the present invention has been described with reference to a few specific embodiments, the description is illustrative of the invention and is not to be construed as limiting the invention. Various modifications may occur to those skilled in the art without departing from the true spirit and scope of the invention as defined by the appended claims.

What is claimed is:

1. A pneumatic hammer for rock drilling in which a piston strikes a button bit while being operated by compressed air in a cylindrical casing, the pneumatic hammer comprising:

a cylindrical casing;

a back head that is screw-engaged with an upper portion of the casing, the back head having a center hole configured to receive compressed air, an inner hollow space that is separated from the center hole by an inner peripheral edge portion, and at least four air passageways arranged circumferentially on a circle having a common center with the inner hollow space, the air passageways including a plurality of first air passageways that connect the center hole and the inner hollow space via an outlet aperture, and a plurality of second air passageways that are open at a lower end thereof, and that communicate with the inner hollow space via an inlet aperture, wherein the first and second air passageways are alternately arranged with each other;

a guide installed in the inner hollow space of the back head, the guide including a lower shaft portion, an intermediate anvil portion configured to be inserted into the inner peripheral edge portion of the back head, and a check valve receiving portion formed opposite the lower shaft portion;

a check valve configured to be received in the check valve receiving portion of the guide and elastically supported by a coil spring;

a piston adapted to ascend and descend in the casing, the piston including a reference axial portion having a reference outer diameter R, a first axial portion having an extended outer diameter R1, a second axial portion having an extended outer diameter R2, a third axial portion having an extended outer diameter R3, a piston center hole extending along a piston central axis, and a compressed air passageway extending from the inlet aperture, which is formed between the extended outer diameters R1 and R2, to the outlet aperture, which is formed in the extended outer diameter R3;

a chuck adapted to prevent escape of the piston from the casing and formed integrally with a bushing portion, the chuck having a bit retainer ring mounting recess formed on an inner peripheral surface of an intermediate axial portion thereof and a plurality of chuck guide grooves formed on an inner peripheral surface of a lower end portion thereof;

a button bit having a plurality of circumferential protrusions alternately arranged between a plurality of button bit guide grooves formed on an outer peripheral surface thereof so as to slidably engage with the chuck guide grooves, an outer circumferential groove of length L that is formed on the outer peripheral surface, and a retaining step formed at an upper end of the outer circumferential groove thereof so that a travel length of the button bit is limited to L; and a variable compressed air chamber formed between an outer periphery of the piston and an inner periphery of the casing.

2. The pneumatic hammer as set forth in claim 1, wherein the check valve includes a seating portion having a seating portion inner hollow space formed above a seating portion center hole, and a head portion disposed on the seating portion, wherein:

the head portion includes an elastic rubber element that covers the head portion and has (i) an element slant surface and (ii) a reinforced strip portion formed circumferentially at an element lower end portion, the head portion further includes a skirt having (i) a skirt central axis that extends to a skirt upper end portion and the elastic rubber element and (ii) a skirt slant surface that is inclined upwardly to the skirt central axis and substantially parallel to the element slant surface, and the reinforced strip portion is projected outwardly by a thickness r from the skirt slant surface.

3. The pneumatic hammer as set forth in claim 1, wherein the travel length L is more than 5.7 times the reference outer diameter R, more than 3.2 times the extended outer diameter R3.

4. A method of driving a pneumatic hammer for rock drilling in which a piston strikes a button bit while vertically reciprocating in a cylindrical casing, the method comprising:

in a state where the piston and the button bit are at their lowermost positions, supplying sufficient compressed air though a center hole of a back head to open a check valve, thereby resulting in compressed air being discharged along a first air passageway of the back head and a center hole of the piston to a discharge hole of the button bit;

ascending the piston in the casing by moving an upper portion of the piston into an inner hollow space of the back head, supplying compressed air through the center hole of the back head, from the first air passageway of the back head into a compressed air passageway of the piston and into a lower chamber located under the piston; and descending the piston and striking a top surface of the button bit by supplying compressed air through the center hole of the back head, the first air passageway of the back head, a compressed air chamber that is located between the piston and the casing, and into a second air passageway of the back head.

5. A pneumatic hammer for rock drilling, the hammer comprising a back head configured to receive a supply of compressed air, a joint for engaging the back head with a casing, a check valve mounted inside the joint for selectively interrupting the supply of compressed air, a piston adapted to ascend and descend inside the casing, a chuck that is screw-engaged with a lower portion of the casing, a retainer ring mounted inside the chuck, and a button bit having a center hole mounted at a lower portion of the piston, the button bit being configured to perform drilling work with a rotational force and a striking force of the piston, wherein the back head is screw-engaged with an upper portion of the joint, the joint is screw-engaged at a lower portion thereof with an upper portion of the casing, and the retainer ring limits a travel length of the button bit, wherein the piston includes (i) at least three axial portions having different outer diameters, (ii) a first compressed air passageway formed therein that extends from a first inlet aperture that opens in an upper portion of the piston to an outlet aperture that opens in the lower portion of the piston, (iii) a center hole formed therein that extends from a second inlet aperture to a bottom side of the piston, and (iv) a second compressed air passageway formed therein that extends from a top side of the piston to a side aperture, and wherein the joint includes (i) a guide member formed therein that receives the check valve and divides an inner hollow space of the joint into the upper and lower portions of the joint, and (ii) compressed air inlet aperture that is formed between the guide member and an outer periphery of the joint to thereby form a third compressed air passageway between the joint and the casing, so that in a drilling preparation state, a first compressed air flow path extends through a center hole of the back head, the compressed air inlet aperture, the third compressed air passageway, the second compressed air passageway of the piston, the center hole of the piston and the center hole of the button bit in this order, in a piston ascending state, a second compressed air flow path extends through the center hole of the back head, the compressed air inlet aperture, the third compressed air passageway, the first compressed air passageway of the piston and a variable compressed air chamber formed below the piston in this order, such that compressed air at the top side of the piston is discharged through the second compressed air passageway, the center hole of the piston, and the center hole of the button bit, and in a piston descending state, a third compressed air flow path extends through the center hole of the back head, the compressed air inlet aperture, the third compressed air passageway, the second compressed air passageway and a compressed air chamber located adjacent to the top side of the piston.

6. The pneumatic hammer as set forth in claim 5, wherein the outlet aperture of the piston is formed in all directions about a central axis of the piston.

7. The pneumatic hammer as set forth in claim 5, wherein the back head has a bypass hole and a component assembling hole, such that components mounted in the component assembling hole are formed at symmetrical hexagonal positions of a nut portion of the back head.

* * * * *